US005546907A

United States Patent [19]

Komoriya et al.

[11] Patent Number: 5,546,907

[45] Date of Patent: Aug. 20, 1996

[54] FUEL METERING CONTROL SYSTEM IN INTERNAL COMBUSTION ENGINE

[75] Inventors: Isao Komoriya; Yusuke Hasegawa; Shusuke Akazaki; Hidetaka Maki, all of Wako, Japan

[73] Assignee: Honda Giken Kogyo Kabushiki Kaisha, Tokyo, Japan

[21] Appl. No.: 507,977

[22] Filed: Jul. 27, 1995

[30] Foreign Application Priority Data

Jul. 29, 1994 [JP] Japan ..... 6-197238

[51] Int. Cl.[6] ..... F02D 41/10; F02D 41/18

[52] U.S. Cl. ..... 123/478; 123/492

[58] Field of Search ..... 123/478, 480, 123/486, 492, 493, 494, 571, 90.15, 90.16

[56] References Cited

U.S. PATENT DOCUMENTS

| | | | |
|---|---|---|---|
| 4,446,523 | 5/1984 | Reinke | 364/431.05 |
| 4,805,579 | 2/1989 | Toshimitsu et al. | 123/492 |
| 4,823,755 | 4/1989 | Hirose et al. | 123/486 |
| 4,907,556 | 3/1990 | Ishii et al. | 123/486 |
| 4,949,694 | 8/1990 | Nagaishi et al. | 123/486 |
| 4,967,715 | 11/1990 | Hosaka | 123/478 |
| 4,996,960 | 3/1991 | Nishiyama et al. | 123/492 |
| 5,035,225 | 7/1991 | Mizukoshi | 123/492 |
| 5,134,981 | 8/1992 | Takahashi et al. | 123/492 |
| 5,205,260 | 4/1993 | Takahashi et al. | 123/492 |
| 5,215,061 | 6/1993 | Ogawa et al. | 123/492 |
| 5,261,370 | 11/1993 | Ogawa et al. | 123/492 |
| 5,331,934 | 7/1994 | Asama et al. | 123/492 |
| 5,349,933 | 9/1994 | Hasegawa et al. | 123/486 |
| 5,353,768 | 10/1994 | Messih et al. | 123/492 |
| 5,427,072 | 6/1995 | Udo | 123/492 |
| 5,448,978 | 9/1995 | Hasegawa et al. | 123/480 |

FOREIGN PATENT DOCUMENTS

| | | |
|---|---|---|
| 2-157451 | 6/1990 | Japan . |
| 2-275043 | 11/1990 | Japan . |

*Primary Examiner*—Willis R. Wolfe

*Attorney, Agent, or Firm*—Nikaido, Marmelstein, Murray & Oram LLP

[57] ABSTRACT

A system for controlling fuel metering in an internal combustion engine using a fluid dynamic model with the quantity of throttle-past air being determined therefrom. Based on the observation that the difference between the steady-state engine operating condition and the transient engine operating condition can be described as the difference in the effective throttle opening areas, the quantity of fuel injection is determined from the product of the ratio between the area and its first-order lag value and the quantity of fuel injection under the steady-state engine operating condition obtained by mapped data retrieval and by subtracting the quantity of correction corresponding to the quantity of chamber-filling air. A pseudo-manifold pressure is estimated and is used for calculating the effective throttle opening area and its first lag value. The pseudo-manifold pressure is corrected by atmospheric pressure, engine coolant water temperature, etc., so as to enhance estimation accuracy.

16 Claims, 20 Drawing Sheets

FIG. 9

| | Pb |
|---|---|
| Ne | Desired A/F |

FUEL METERING CONTROL SYSTEM IN INTERNAL COMBUSTION ENGINE

BACKGROUND OF THE INVENTION

1. Field of the Invention

This invention relates to a system for controlling fuel metering in an internal combustion engine, more particularly to a system for controlling fuel metering in an internal combustion engine wherein the quantity of fuel injection is optimally determined over the entire range of engine operating conditions including transient engine operating condition using an intake air model and by simplifying its calculation.

2. Description of the Prior Art

In a conventional fuel metering control system, the quantity of fuel injection was usually determined by retrieving mapped data predetermined through experimentation and stored in advance in a microcomputer memory using parameters having intrinsically high degrees of correlation with the quantity of air drawn in the engine cylinder. As a result, the conventional technique was utterly powerless to cope with any change in the parameters which had not been taken into account at the time of preparing the mapped data. Further, since the mapped data were intrinsically prepared solely focussing on the steady-state engine operating condition and the transient engine operating condition was not accounted for, the conventional technique was unable to determine the quantity of fuel injection under the transient engine operating condition with accuracy. For that reason, there are recently proposed techniques to establish a fluid dynamic model describing the behavior of the air intake system so as to accurately estimate the quantity of air drawn in the cylinder such as disclosed in Japanese Laid-Open Patent Application 2(1990)-157,451 or U.S. Pat. No. 4,446,523.

Similarly the assignee proposed in Japanese Patent Application 4(1992)-200,330 (filed in the United States on Jul. 2, 1993 under the Ser. No. of 08/085,157) a method for estimating the quantity of air drawn in the cylinder by determining the quantity of throttle-past air while treating the throttle (valve) as an orifice to establish a fluid dynamic model based on the standard orifice equation for compressible fluid flow. The fluid dynamic model therein was, however, premised on an ideal state and required various assumptions. It was therefore impossible to wipe out all the errors which could be introduced at the time of modeling. Further, since it was quite difficult to accurately determine constants such as the specific-heat ratio used in the model, errors possibly arising therefrom could disadvantageously be accumulated. Furthermore, the equation necessitated calculation of powers, roots or the like. Since approximate values were used for them in practice, additional errors resulted.

The assignee therefore proposed in Japanese Patent Applications 4(1992)-306,086 and in the additional application claiming the domestic priority thereof (5(1993)-186,850)(both filed in the United States on Oct. 18, 1993 under the Ser. No. of 08/137,344 and patented under U.S. Pat. No. 5,349,933) a system for controlling fuel metering in an internal combustion engine which, although it was based on a fluid dynamic model, could absorb errors in the model equations and optimally determine the quantity of fuel injection over the entire range of engine operating conditions including the transient engine operating condition without conducting complicated calculations, perceiving the difference between the steady-state engine operating condition and the transient engine operating condition as the difference in the effective throttle opening areas.

In addition, the assignee proposed an improvement of the technique in Japanese Patent Application 5(1993)-208,835 (filed in the United States and patented as above). In the proposed technique, noting the fact that the manifold pressure can be solely determined from the throttle opening under the steady-state engine operating condition when the engine speed is constant and even under the transient engine operating condition, and that the manifold pressure can be determined from the first-order lag value of the throttle opening, the assignee proposed to estimate a pseudo-manifold pressure from the engine speed and the throttle opening's first-order lag value and to obtain the effective throttle opening area at the transient engine operating condition using the estimated value.

SUMMARY OF THE INVENTION

An object of the invention is therefore to improve the assignee's earlier proposed techniques and to provide a system for controlling fuel metering in an internal combustion engine which can enhance the accuracy of estimation of the pseudo-manifold pressure, thereby ensuring optimal determination of the quantity of fuel injection over the entire range of engine operating conditions including the transient engine operating condition.

A second object of the invention is to provide a system for controlling fuel metering in an internal combustion engine which can optimally determine the quantity of fuel injection based on mapped data even in an engine operational environment different from that expected at the time of preparing the mapped data.

For realizing the objects, the present invention provides a system for controlling fuel metering in an internal combustion engine, including engine operating condition detecting means for detecting parameters indicating an engine operating condition at least including an engine speed (Ne), a manifold pressure (Pb) and a throttle valve opening (θTH), fuel injection quantity obtaining means for obtaining a quantity of fuel injection (Timap) in accordance with a predetermined characteristic at least based on the engine speed (Ne) and the manifold pressure (Pb), pseudo-manifold pressure determining means for determining an n-th order lag value (θTH-D) of the throttle valve opening (θTH) to determine a pseudo-manifold pressure ($\hat{P}b$) at least based on the n-th order lag value (θTH-D) and the engine speed (Ne), first effective throttle opening area determining means for determining an effective throttle opening (A) at least based on the throttle valve opening (θTH) and the pseudo- manifold pressure ($\hat{P}b$), second effective throttle opening area determining means for determining a value (ADELAY) indicating an n-th order lag of the effective throttle opening area (A) at least based on the n-th order lag value (θTH-D) of the throttle valve opening (θTH) and the pseudo-manifold pressure ($\hat{P}b$), and fuel injection quantity determining means for determining a quantity of fuel injection (Tout) by multiplying the quantity of fuel injection (Timap) by a ratio between the effective throttle opening area (A) and the value (ADELAY) as $$Tout=Timap\times A/ADELAY.$$

The system is arranged such that said first and second effective throttle opening area determining means corrects the pseudo-manifold pressure ($\hat{P}b$) by the engine operating condition.

BRIEF DESCRIPTION OF THE DRAWINGS

These and other objects and advantages of the invention will be more apparent from the following description and drawings, in which:

FIG. 9 is a view explaining a characteristic of mapped data of a desired air/fuel ratio used in the calculation of the system;

DETAILED DESCRIPTION OF THE PREFERRED EMBODIMENTS

The embodiments of the invention will now be explained with reference to the drawings.

Figure 1:
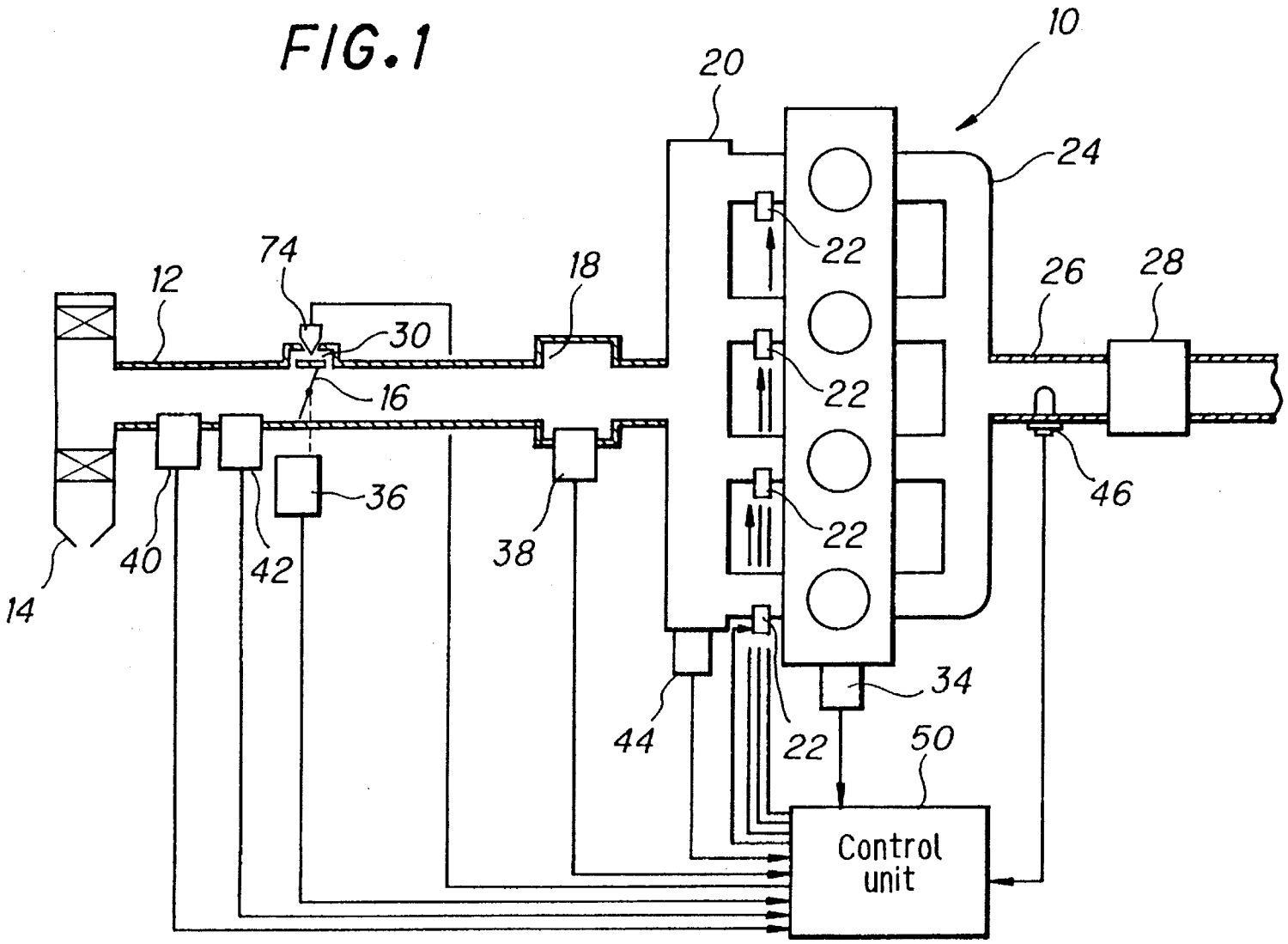
FIG. 1 is an overall block diagram showing a fuel metering control system according to the invention.

An overall view of the fuel metering control system according to the invention is shown in FIG. 1. Reference numeral 10 in this figure designates a four cylinder internal combustion engine. Air drawn in an air intake pipe 12 through an air cleaner 14 mounted on its far end is supplied to first to fourth cylinders through a surge tank (chamber) 18 and an intake manifold 20 while the flow thereof is adjusted by a throttle valve (plate) 16. A fuel injector 22 for injecting fuel is installed in the vicinity of the intake valve (not shown) of each cylinder. The injected fuel mixes with the intake air to form an air-fuel mixture that is introduced and ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 24, from where it passes through an exhaust pipe 26 to a three-way catalytic converter 28 where it is cleared of noxious components before being discharged to atmosphere. The air intake pipe 12 is provided with a secondary path 30 which bypasses the throttle valve 16.

A crank angle sensor 34 for detecting the piston crank angles is provided in a distributor (not shown) of the internal combustion engine 10, a throttle position sensor 36 is provided for detecting the degree of opening θTH of the throttle valve 16, and a manifold absolute pressure sensor 38 is provided for detecting the absolute pressure Pb of the intake air downstream of the throttle valve 16. On the upstream side of the throttle valve 16, there are provided an atmospheric pressure sensor 40 for detecting the atmospheric (barometric) pressure Pa, and an intake air temperature sensor 42 for detecting the temperature of the intake air Ta. And a second temperature sensor 44 is provided for detecting the engine coolant water temperature Tw. In addition, an air/fuel ratio sensor 46 comprising an oxygen concentration detector is provided in the exhaust system at a point downstream of the exhaust manifold 24 and upstream of the three-way catalytic converter 28, where it detects the air/fuel ratio of the exhaust gas. The outputs of the sensor 34, etc., are sent to a control unit 50.

Figure 2:
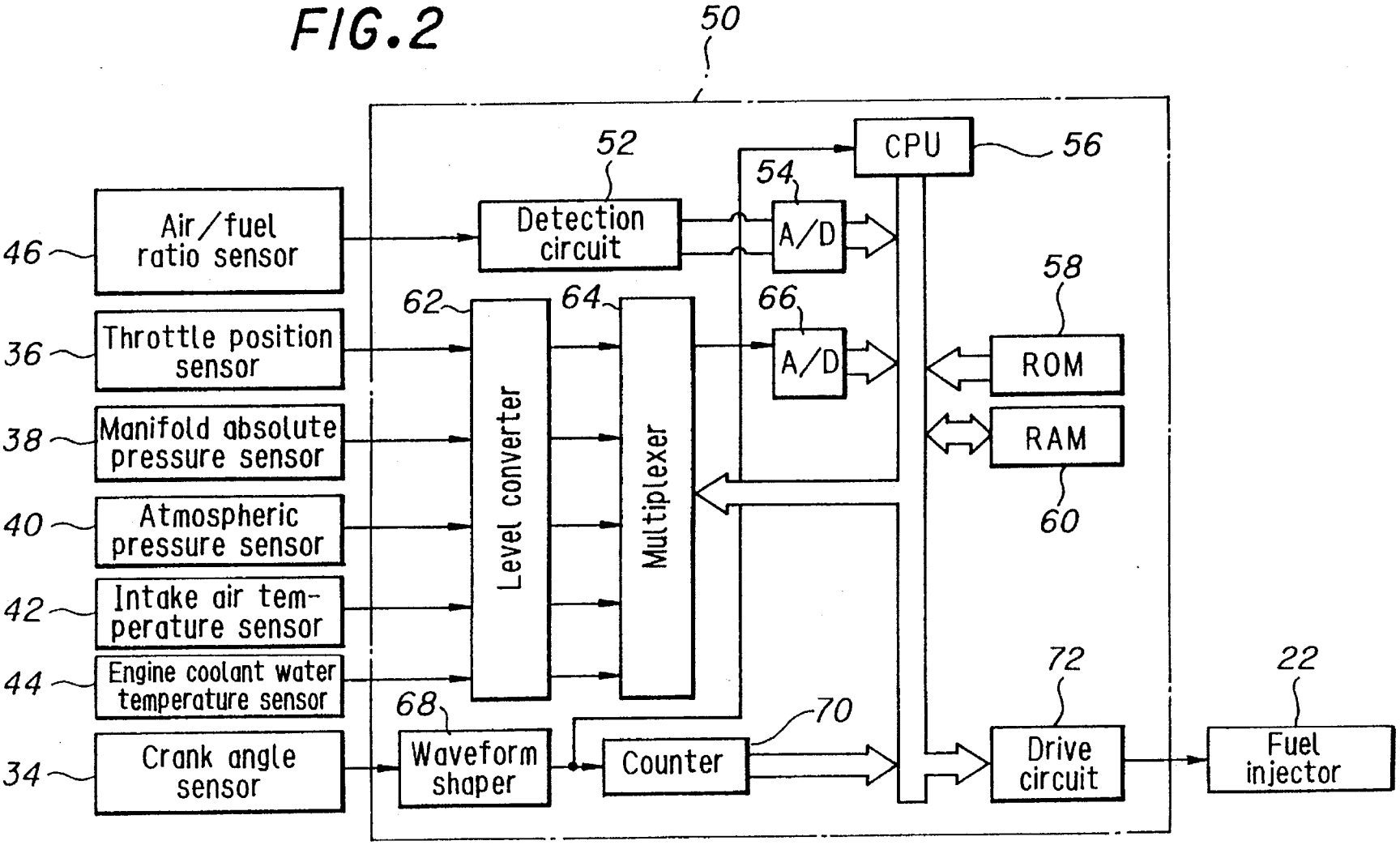
FIG. 2 is a block diagram showing the details of the control unit illustrated in FIG. 1.

Details of the control unit 50 are shown in the block diagram of FIG. 2. The output of the air/fuel ratio sensor 46 is received by a detection circuit 52 of the control unit 50, where it is subjected to appropriate linearization processing to obtain an air/fuel ratio characterized in that it varies linearly with the oxygen concentration of the exhaust gas over a broad range extending from the lean side to the rich side. The output of the detection circuit 52 is forwarded through an A/D (analog/digital) converter 54 to a microcomputer comprising a CPU (central processing unit) 56, a ROM (read-only memory) 58 and a RAM (random access memory) 60 and is stored in the RAM 60. Similarly, the analog outputs of the throttle position sensor 36, etc., are input to the microcomputer through a level converter 62, a multiplexer 64 and a second A/D converter 66, while the output of the crank angle sensor 34 is shaped by a waveform shaper 68 and has its output value counted by a counter 70, the result of the count being input to the microcomputer. In accordance with commands stored in the ROM 58, the CPU 56 of the microcomputer computes the quantity of fuel injection in a manner explained later and drives the fuel injector 22 of the individual cylinders via a drive circuit 72. Similarly, the CPU 56 calculates a manipulated variable and drives a solenoid valve (EACV) 74 (FIG. 1) via a drive circuit (not shown) to control the quantity of secondary air passing the bypass 30.

Figure 3:
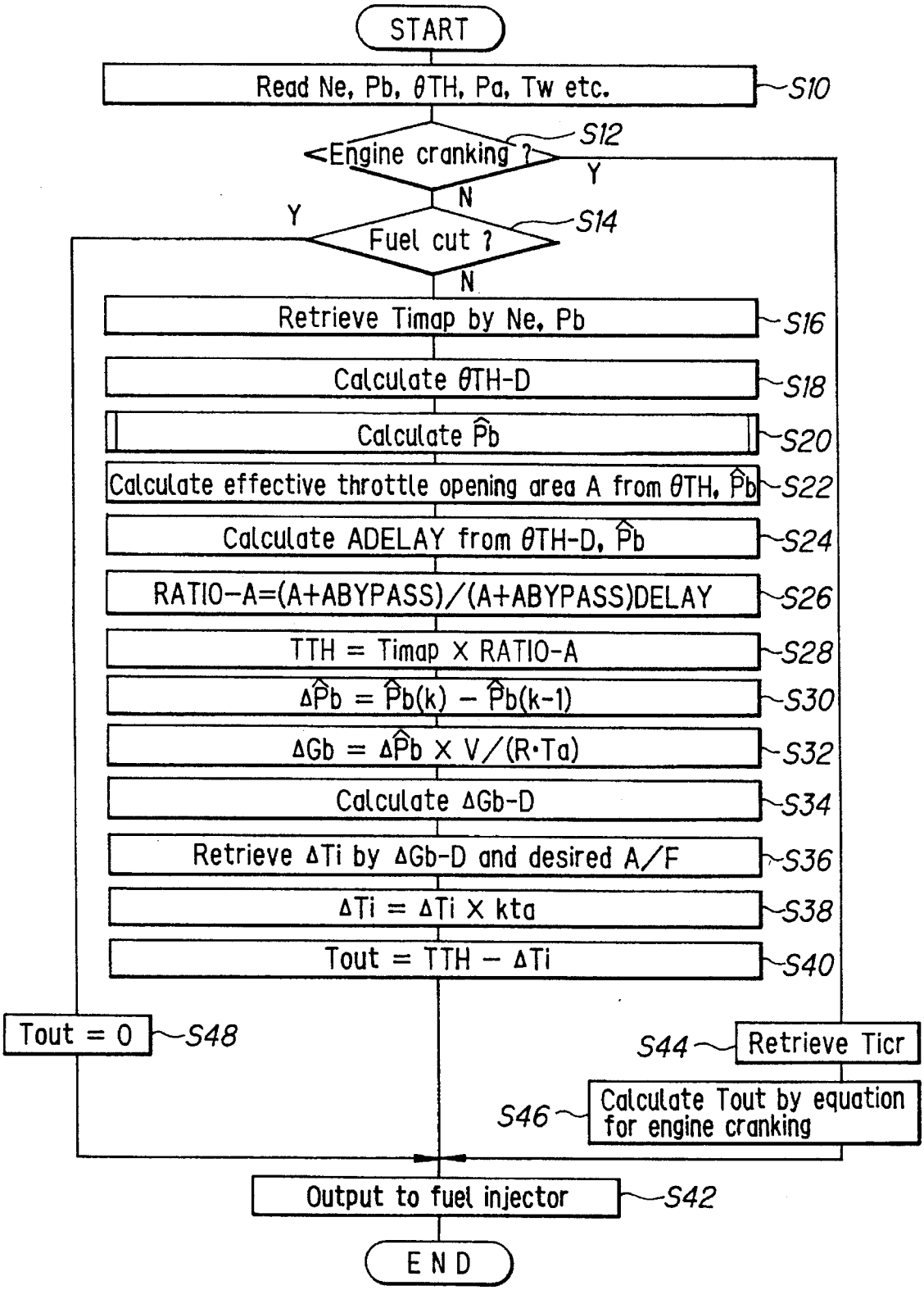
FIG. 3 is a flowchart showing the operation of the fuel metering control system according to the invention.

FIG. 3 is a flow chart showing the operation of the system. Before entering into the explanation of the figure, however, air flow estimation using a fluid dynamic model on which the invention is based, will first be explained. Since the method was fully described in the aforesaid assignee's earlier application, the explanation will be made in brief.

$\gamma_1$: Air specific weight on upstream side ($= \rho_1 \cdot g$)

$\alpha$: Flow rate coefficient (coefficient of discharge)

$$\left( = \frac{C_v \cdot C_c}{\sqrt{1 - C_c^2 (d/D)^4}} \right)$$

where:

$C_v$: Velocity coefficient $C_c$: Contraction coefficient [$=f(S/A_{up})$]

$D$: Bore diameter on upstream side $d$: Throttle aperture diameter $\epsilon$: Correction coefficient (expansion factor of gas)

$$\left( = \frac{\left(\frac{\kappa}{\kappa-1}\right)\left(\left(\frac{P_2}{P_1}\right)^{(2/\kappa)} - \left(\frac{P_2}{P_1}\right)^{((\kappa+1)/\kappa)}\right)(1 - C_c^2(d/D)^4)}{(1 - P_2/P_1)\left(1 - \left(\frac{P2}{P_1}\right)^{(2/\kappa)} \cdot C_c^2(d/D)^4\right)} \right)$$

$$\begin{aligned} Gth &= \epsilon \cdot \rho_1 \cdot \alpha \cdot S \cdot \sqrt{\frac{2g \cdot (P_1 - P_2)}{\gamma_1}} \\ &= C \cdot S \cdot \rho_1 \cdot \sqrt{\frac{2g \cdot (P_1 - P_2)}{\gamma_1}} \\ &= A \cdot \rho_1 \cdot \sqrt{\frac{2g \cdot (P_1 - P_2)}{\gamma_1}} \\ &\approx A \cdot \rho_1 \cdot \sqrt{\frac{2g \cdot (Pa - Pb)}{\gamma_1}} \end{aligned} \qquad \text{Eq. 5}$$

Figure 5:
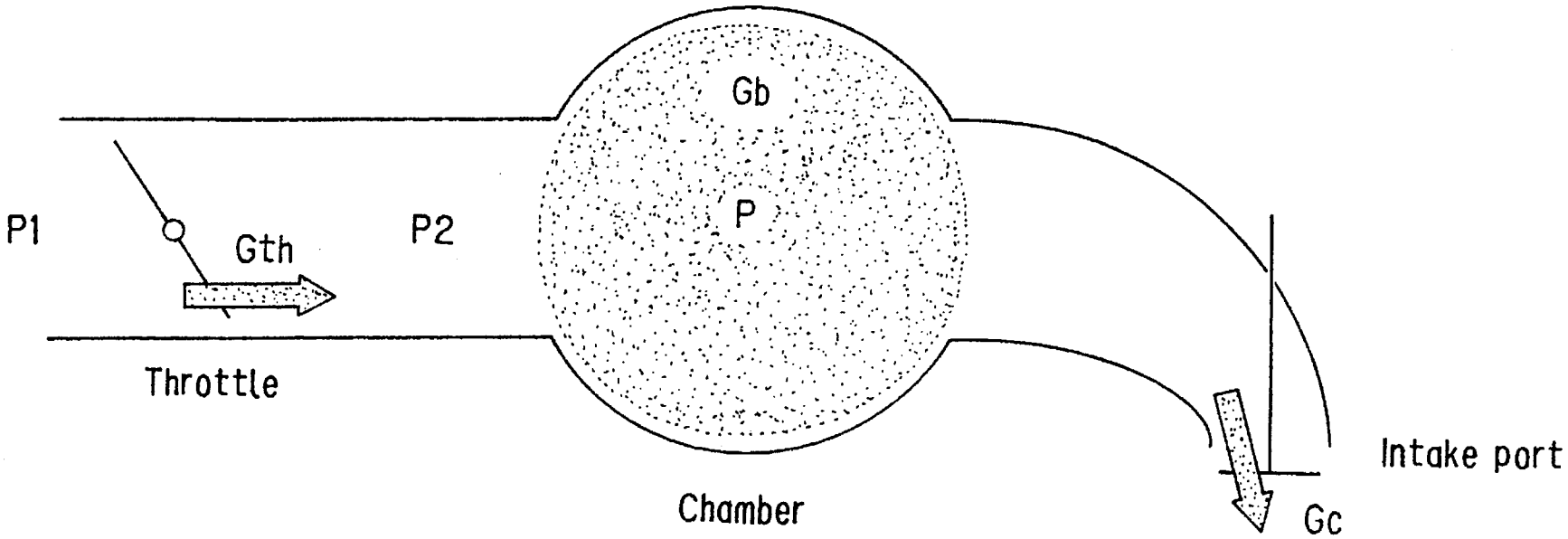
FIG. 5 is a view showing an air intake system model used in the system.

First, if the throttle (valve) is viewed as an orifice as shown in an air intake system model of FIG. 5, it is possible from Eq. 1 (Bernoulli's equation), Eq. 2 (equation of continuity) and Eq. 3 (relational equation of adiabatic process) to derive Eq. 4, which is the standard orifice equation for compressible fluid flow. Eq. 4 can be rewritten as Eq. 5 and based on it, it is thus possible to determine the quantity of throttle-past air Gth per unit time:

$$\frac{v_1^2}{2} + \frac{\kappa}{\kappa-1} \cdot \frac{P_1}{\rho_1} = \frac{v_2^2}{2} + \frac{\kappa}{\kappa-1} \cdot \frac{P_2}{\rho_2} \qquad \text{Eq. 1}$$

where the flow is assumed to be the adiabatic process, and $P_1$: Absolute pressure on upstream side $P_2$: Absolute pressure on downstream side $\rho_1$: Air density on upstream side $\rho_2$: Air density on downstream side $v_1$: Flow velocity on upstream side $v_2$: Flow velocity on downstream side $\kappa$: Specific-heat ratio $$\rho_1 \cdot v_1 \cdot A_{up} = \rho_2 \cdot v_2 \cdot S \qquad \text{Eq. 2}$$

where:

$A_{up}$: Flow passage area on upstream side

S: Throttle projection area [=f (θTH) ]

$$\frac{P_1}{\rho_1^\kappa} = \frac{P_2}{\rho_2^\kappa} \qquad \text{Eq. 3}$$

$$Gth = \epsilon \cdot \rho_1 \cdot \alpha \cdot S \cdot \sqrt{\frac{2g \cdot (P_1 - P_2)}{\gamma_1}} \qquad \text{Eq. 4}$$

where:

g: Gravitational acceleration where:

$C = \epsilon \cdot \alpha$ $A = C \cdot S$

S: Throttle projection area

A: Effective throttle opening area

Pa: Atmospheric pressure

Pb: Manifold absolute pressure

Figure 6:
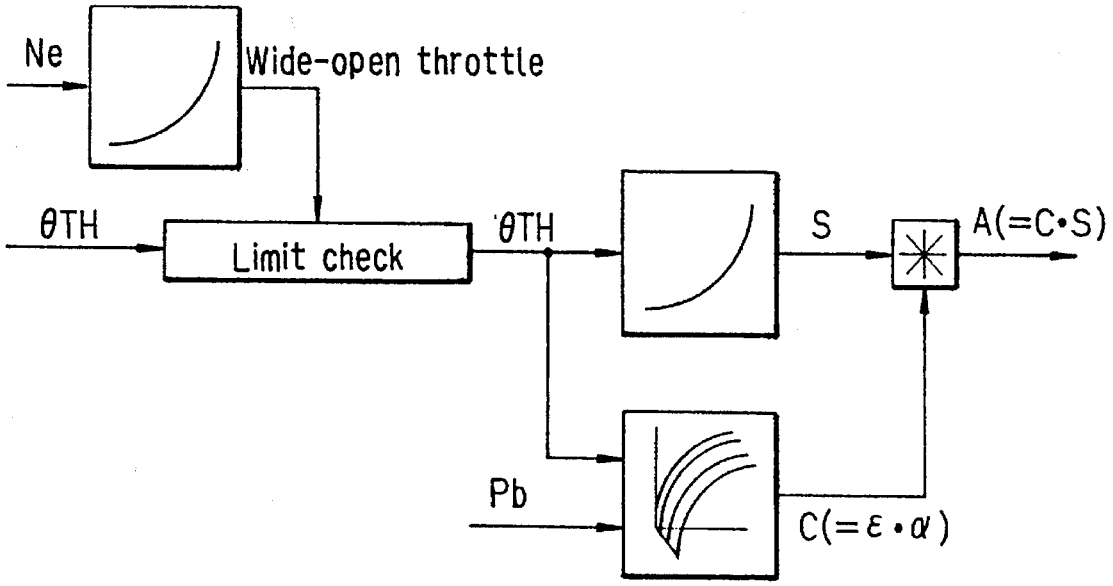
FIG. 6 is a block diagram showing the calculation of an effective throttle opening area and its first-order lag value used in the calculation of the system.
Figure 7:
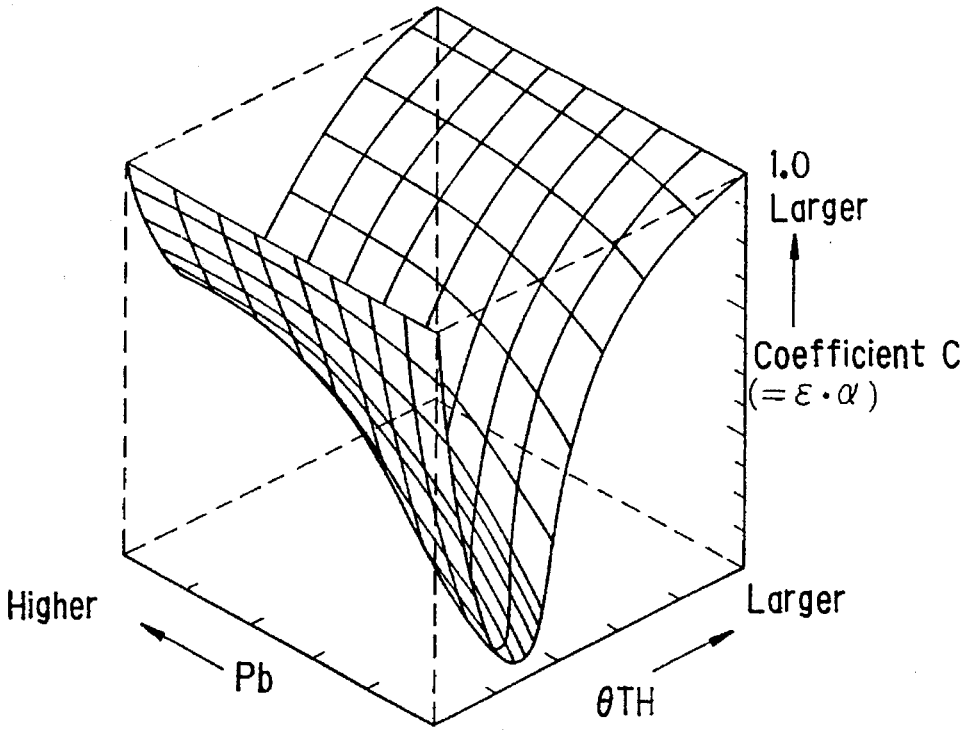
FIG. 7 is a view showing a characteristic of mapped data of a coefficient shown in FIG. 6.

More specifically, on the basis of the detected throttle opening θTH, the throttle's projection area S (formed on a plane perpendicular to the longitudinal direction of the air intake pipe 12 when the throttle valve 16 is assumed to be projected in that direction) is determined in accordance with a predetermined characteristic, as illustrated in the block diagram of FIG. 6. At the same time, the discharge coefficient C which is the product of the flow rate coefficient α and gas expansion factor epsilon, is retrieved from mapped data whose characteristic is illustrated in FIG. 7 using the throttle opening θTH and manifold pressure Pb as address data, and the throttle projection area S is multiplied by the coefficient C retrieved to obtain the effective throttle opening area A. According to Eq. 5, the value A is multiplied by the air specific weight rho 1 and the root to determine the quantity of throttle-past air Gth. Here, the pressures P1, P2 in the root can be substituted by atmospheric pressure Pa and manifold pressure Pb. Since the throttle does not function as an orifice in its wide-open (full-throttling) state, the full load opening areas are predetermined empirically as limited values with respect to engine speed. And when a detected throttle opening is found to exceed the limit value concerned, the detected value is restricted to the limit value. The value will further be subject to atmospheric correction (explained later).

Next, the quantity of chamber-filling air, referred hereinafter to as "Gb", is calculated by using Eq. 6, which is based on the ideal gas law. The term "chamber" is used here to mean not only the part corresponding to the so-called surge tank but to all portions extending from immediately downstream of the throttle to immediately before the cylinder intake port:

$$Gb(k) = \frac{V}{R \cdot T} \cdot P(k) \quad \text{Eq. 6}$$

where:

V: Chamber volume

T: Air temperature

R: Gas constant

P: Chamber pressure

Then, the quantity of chamber-filling air at the current control cycle delta Gb(k) can be obtained from the pressure change in the chamber delta P using Eq. 7. It should be noted that "k" means the current control (program) cycle and "k–n" the control cycle at a time n earlier in the discrete control system, but the appending of the suffix (k) is omitted for most values at the current control cycle in the specification:

$$\Delta Gb(k) = Gb(k) - Gb(k-1) = \frac{V}{R \cdot T} \cdot (P(k) - P(k-1)) = \frac{V}{R \cdot T} \cdot \Delta P(k) \quad \text{Eq. 7}$$

When it is assumed that the quantity of chamber-filling air delta Gb(k) at the current control cycle is not, as a matter of fact, inducted into the cylinder, then the actual quantity of air drawn in the cylinder Gc per time unit delta T can be expressed as Eq. 8:

$$Gc = Gth \cdot \Delta T - \Delta Gb \quad \text{Eq.8}$$

Figure 8:
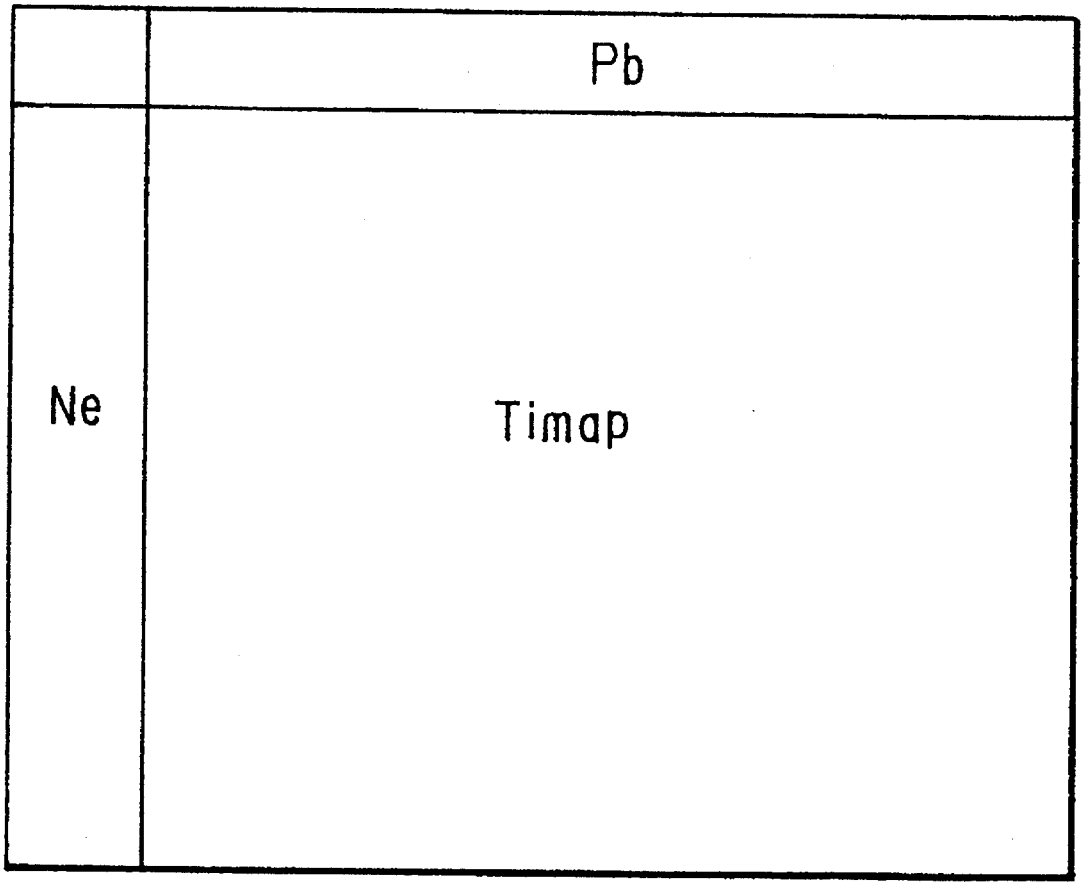
FIG. 8 is a view explaining a characteristic of mapped data of the quantity of fuel injection under the steady-state engine operating condition Timap.

On the other hand, the quantity of fuel injection under the steady-state engine operating condition Timap is prepared in advance in accordance with the so-called speed density method and stored in the ROM 58 as mapped data with respect to engine speed Ne and manifold pressure Pb as illustrated in FIG. 8. Since the quantity of fuel injection Timap is established in the mapped data in accordance with a desired air/fuel ratio which in turn is determined in accordance with the engine speed Ne and the manifold pressure Pb, the desired air/fuel ratio is therefore prepared in advance and stored as mapped data with respect to the same parameters as shown in FIG. 9 to be later used for determining the quantity of correction delta Ti for correcting the quantity of fuel injection Timap. The quantity of fuel injection Timap is established such that it satisfies the aforesaid fluid dynamic model under the steady-state engine operating condition. Specifically, the quantity of fuel injection Timap is established in terms of the opening period of the fuel injector 22.

Here, when contemplating the relationship between the quantity of fuel injection Timap retrieved from the mapped data and the quantity of throttle-past air Gth, the quantity of fuel injection Timap retrieved from the mapped data, here referred to as Timap1, will be expressed as Equation 9 at a certain aspect under the stable-state engine operating condition defined by engine speed Ne1 and manifold pressure Pb1:

$$\text{Timap1} = \text{MAPPED DATA (Ne1, Pb1)} \quad \text{Eq. 9}$$

In that situation, the quantity of fuel injection determined theoretically from the aforesaid fluid dynamic model, here referred to as Timap1', will be expressed as Equation 10 when the desired air/fuel ratio is set to be the stoichiometric air/fuel ratio (14.7:1). Here, the value with symbol "'" indicates that value determined theoretically from the fluid dynamic model. The suffix "1" appended to the parameters indicates a specific value at the steady-state engine operating condition, while the suffix "2" (appearing later) indicates a specific value at the transient engine operating condition:

$$Timap1' = Gth1 \cdot \Delta T/14.7 \quad \text{Eq. 10}$$

$$\text{where } Gth1 = A1 \cdot \rho_1 \cdot \sqrt{2g \frac{Pa - Pb1}{\gamma_1}}$$

Figure 10:
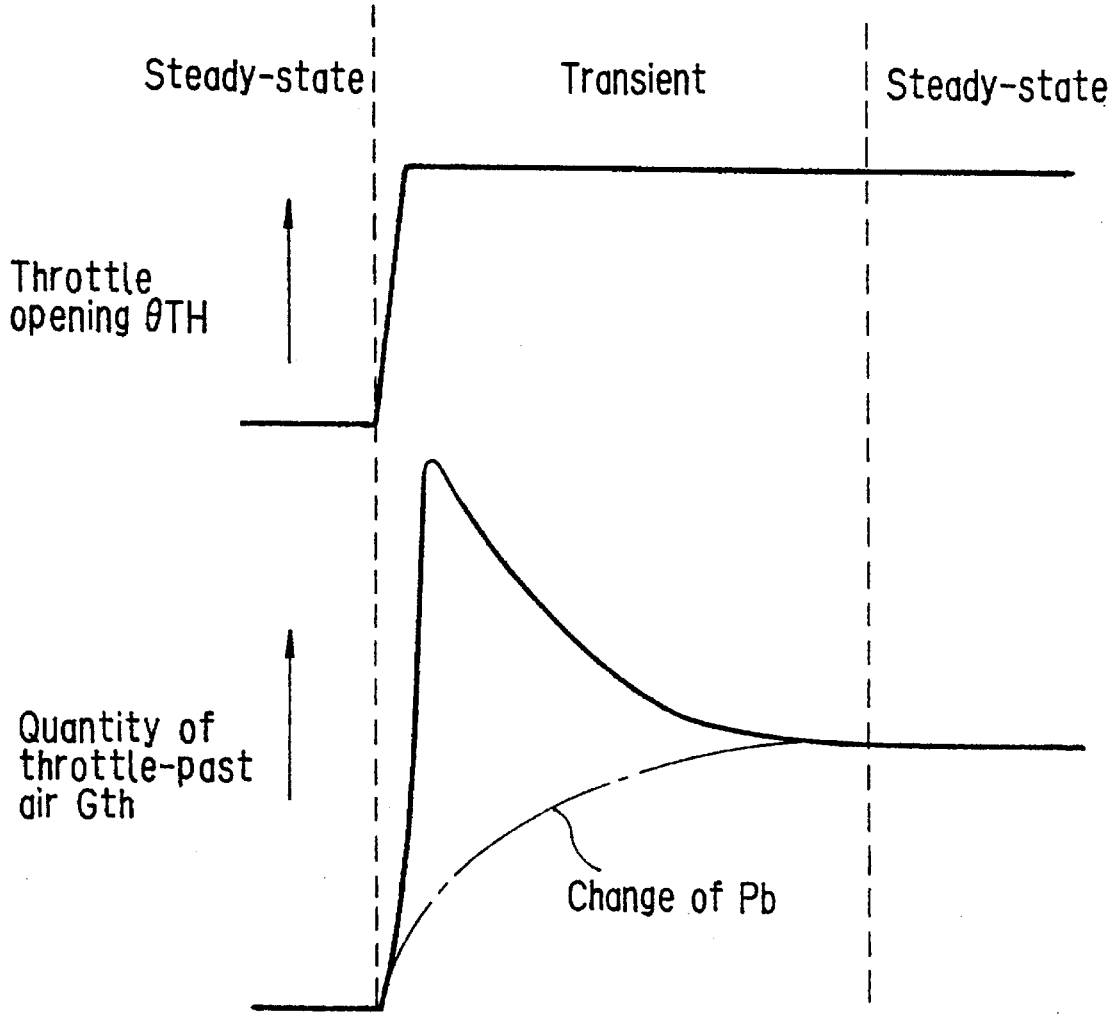
FIG. 10 is a timing chart explaining the transient engine operating condition referred to in the specification.

Assuming that the mapped data are prepared to satisfy the model equations as mentioned before, the quantity of fuel injection Timap1 retrieved from the mapped data and the quantity of fuel injection Timap1' obtained from the model equations become equal. Then, when retrieving the quantity of fuel injection from the mapped data at the same condition (i.e., Ne=Ne1, Pb=Pb1) during the transient engine operating condition, it will be the same as that under the steady-state engine operating condition as shown in Eq. 11. Here, in the specification "the transient engine operating condition" is used to mean in the specification a transitional phase between the steady-state engine operating conditions as illustrated in FIG. 10:

$$\text{Timap1} = \text{MAPPED DATA (Ne1, Pb1)} \quad \text{Eq. 11}$$

On the other hand, the quantity of fuel injection Timap2' determined from the model equations will be expressed as Eq. 12 and will not be the same as the value retrieved from the mapped data:

$$Timap2' = Gth2 \cdot \Delta T/14.7 - \Delta Gb2/14.7 \quad \text{Eq. 12}$$

where, $$Gth2 = A2 \cdot \rho_1 \cdot \sqrt{2g \frac{Pa - Pb1}{\gamma_1}}$$

In order to solve the discrepancy therebetween, it therefore becomes necessary to conduct complicated calculations based on the fluid dynamic model.

Here, however, when comparing the quantity of throttle-past air Gth1 under the steady-state engine operating condition shown in Eq. 10 and Gth2 under the transient engine operating condition shown in Eq. 12, it can be found that the difference is related only to the effective throttle opening area A. Accordingly, the quantity of throttle-past air Gth2 under the transient engine operating condition can be expressed as Eq. 13:

$$Gth2 = \frac{A2}{A1} Gth1 \quad \text{Eq. 13}$$

In other words, it is possible to determine the quantity of throttle-past air Gth2 under the transient operating condition from the quantity of throttle-past air Gth1 under the steady-state engine operating condition and a ratio between the effective throttle opening areas A1, A2 of both conditions.

On the other hand, since the quantity of throttle-past air Gth1 under the steady-state engine operating condition can be obtained from the quantity of fuel injection Timap1 retrieved from the mapped data as shown in Eq. 14, the quantity of throttle-past air Gth2 under the transient engine operating condition can be obtained in a manner shown in Eq. 15:

$$Gth1 = Timap1' \cdot 14.7/\Delta T = Timap1 \cdot 14.7/\Delta T \quad \text{Eq. 14}$$

$$Gth2 = \frac{A2}{A1} Timap1 \cdot 14.7/\Delta T \quad \text{Eq. 15}$$

Using Eqs. 12 and 15, as a result, it becomes possible to determine the quantity of fuel injection Timap2' under the transient engine operating condition from the basic quantity of fuel injection Timap1 retrieved from the mapped data, the ratio A2/A1 between the effective throttle opening areas and the quantity of correction delta Ti corresponding to the quantity of chamber-filling air delta Gb2, as expressed in Eq. 16:

$$Timap2' = \frac{A2}{A1} Timap1 - \Delta Ti \quad \text{Eq. 16}$$

where $$\Delta Ti = (\Delta Gb2/14.7) \times ki$$

In Eq. 16, "ki" is a coefficient for converting the quantity of fuel injection into an injector's opening period.

Figure 11:
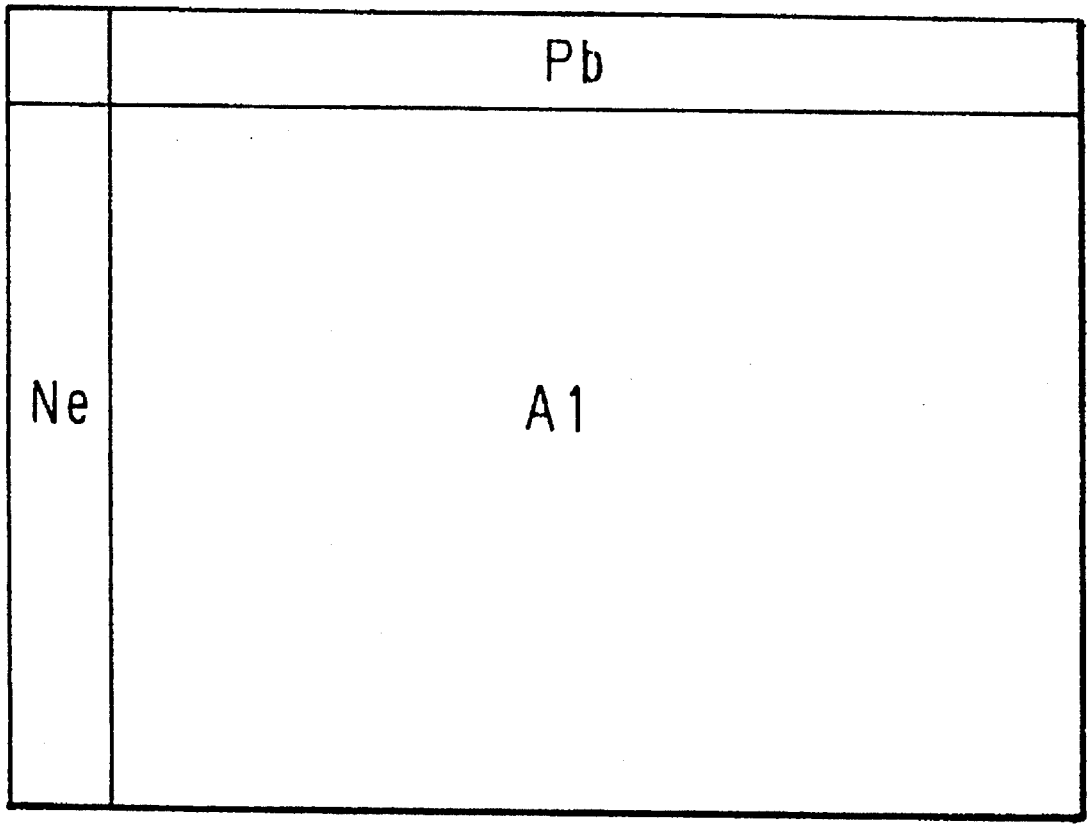
FIG. 11 is a view explaining a characteristic of mapped data of an effective throttle opening area under the steady-state engine operating condition.
Figure 12:
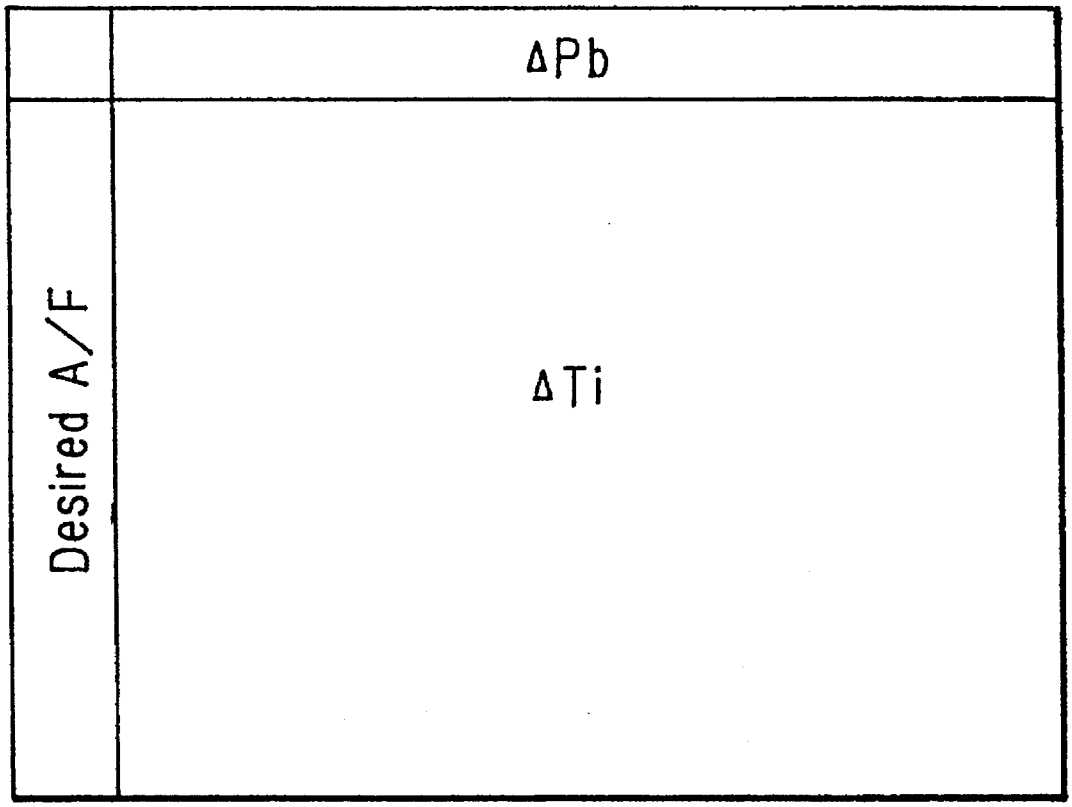
FIG. 12 is a view explaining a characteristic of mapped data of the quantity of correction delta Ti for correcting the quantity Timap.

Therefore, it is arranged such that the effective throttle opening area A1 under the steady-state engine operating condition is calculated in advance and stored as mapped data using engine speed Ne and manifold pressure Pb as address data as illustrated in FIG. 11 in a similar manner to the quantity of fuel injection Timap. Moreover, the quantity of correction delta Ti for correcting the quantity of fuel injection Timap is similarly prepared in advance and stored in the memory in such a manner that it can be retrieved by manifold pressure change delta Pb (the difference between the detected manifold pressure Pb at the current control cycle and that at the last control cycle) and the desired air/fuel ratio (the same ratio used for Timap is to be selected for harmonization), as illustrated in FIG. 12.

Then, after determining the current effective throttle opening area A and obtaining the ratio A/A1 between A and the map-retrieval effective throttle opening area A1, it is possible to determine the output quantity of fuel injection Tout by multiplying the ratio by the quantity of fuel injection Timap and by subtracting the quantity of correction delta Ti. Under the steady-state engine operating condition in which manifold pressure does not change, the quantity of fuel injection Timap will immediately be the output quantity of fuel injection Tout as shown in Eq. 17. Under the transient engine operating condition, the output quantity of fuel injection Tout will be calculated according to the equation shown in Eq. 18:

$$Tout = \frac{A1}{A1} Timap1 - 0 = Timap1 \quad \text{Eq. 17}$$

$$Tout = \frac{A2}{A1} Timap1 - \Delta Ti \quad \text{Eq. 18}$$

It is thus expected that the output quantity of fuel injection Tout is determined even under the transient engine operating condition in the same manner as under the steady-state engine operating condition, ensuring continuity in the fuel metering control. Moreover, even when the effective throttle opening area A1 obtained from mapped data retrieval does not coincide with the current effective throttle opening area A under the steady-state engine operating condition, the output quantity of fuel injection Tout will be determined as shown in Eq. 19, so that it is expected that any factor such as mapped data's initial variance that causes the discrepancy will then be automatically corrected:

$$Tout = \frac{A2}{A1} Timap1 - 0 \quad \text{Eq. 19}$$

However, after validating the control through repeated computer simulations, it has been found that the effective throttle opening area A1 did not coincide with the current effective throttle opening area A under the steady-state engine operating condition, and A/A1 does not become 1. Further, measuring the behavior of the quantity of chamber-filling air at the current control cycle delta Gb which was expected to occur when the quantity of throttle-past air increases, it has been found that there was a lag until the quantity of chamber-filling air at the current control cycle was reflected in the quantity of air drawn in the cylinder. The reason for this would be the inconsistency in the sensor detection timings and sensor detection lags, in particular the detection lag of the manifold absolute pressure sensor 38.

Figure 4:
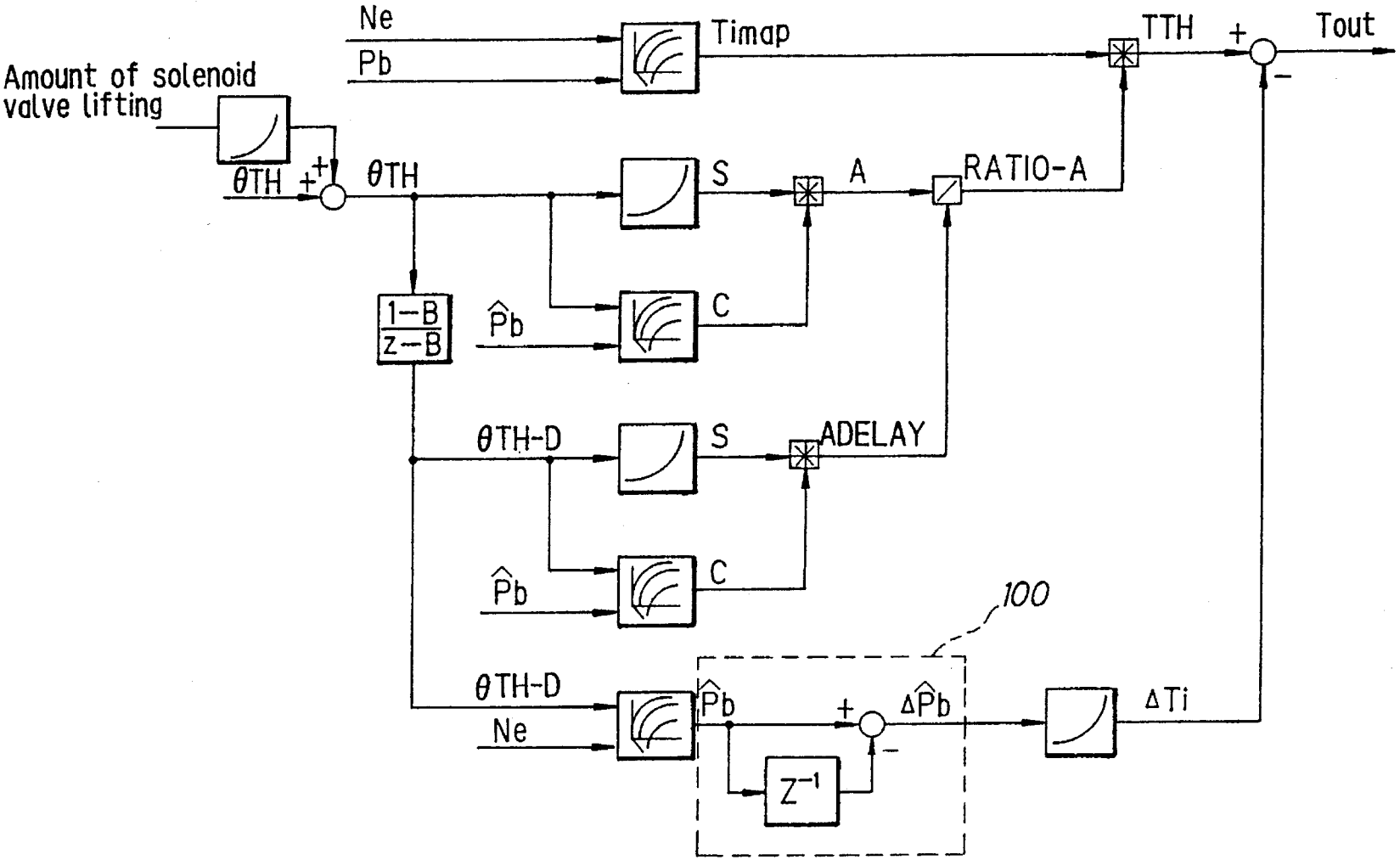
FIG. 4 is a block diagram similarly showing the operation of the system according to the invention.

Then, observing the relationship between the throttle opening θTH and manifold pressure Pb, it has been found that when the engine speed is constant in an engine environment where the engine coolant temperature and the atmospheric pressure, etc., remain unchanged, the manifold pressure can be solely determined from the throttle opening when the engine is under the steady-state operating condition. Even under the transient engine operating condition illustrated in FIG. 10, it can be considered that the manifold pressure has the first-order lag relationship with the change of the throttle opening. Based on the observation, as is illustrated in FIG. 4 and as will later be illustrated in FIG. 16, the system is now rearranged such that the first-order lag value of the throttle opening (the lag referred hereinafter to as "θTH-D"), is first obtained and from the value θTH-D and the engine speed Ne, a second value is obtained in accordance with a predetermined characteristic, a pseudo-value (hereinafter referred to as "pseudo-manifold pressure P̂b") is obtained. With the arrangement, it has been considered that the sensor' detection timing gap and the manifold pressure sensor's detection lag can be solved.

Figures 13, 13A:
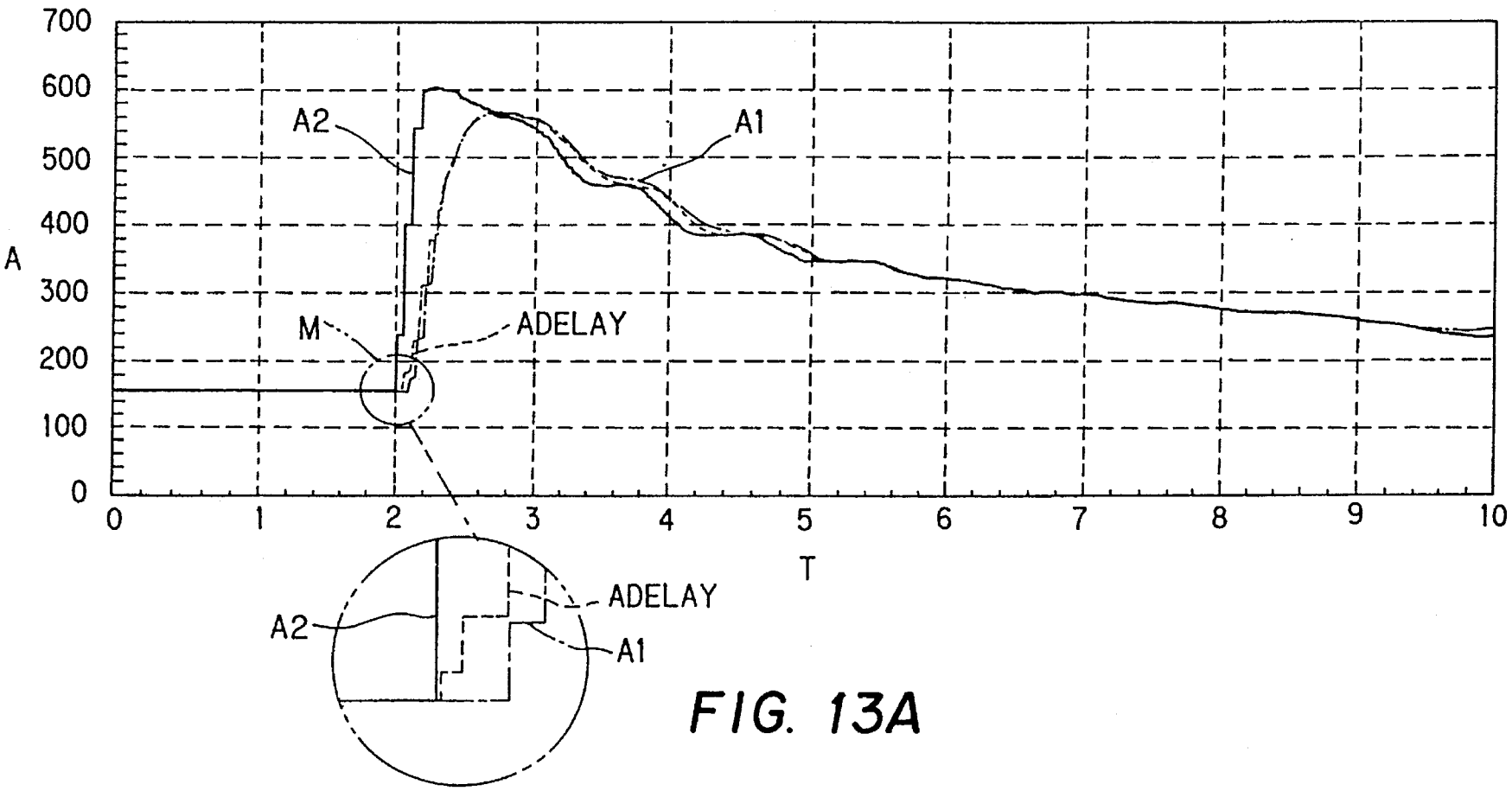
FIGS. 13 and 13A are graphs showing the result of simulation using an effective throttle opening area's first-order lag value.

Observing further the behavior of the effective throttle opening area, it is considered that the aforesaid value A1 retrieved from the mapped data is able to be determined from the first-order lag value of the current effective throttle opening area A. And after verifying it through computer simulations, it has been validated as shown in FIG. 13. More specifically, when the first-order lag value of the area A is called "ADELAY", comparing A2/A1 with A/ADELAY, leads to comparing A1 and ADELAY, provided that A2 is identical to A. It can be found that A1 rises behind the rise of A2(A) due to the manifold pressure sensor's detection lag, whereas the value ADELAY follows A2(A) relatively faithfully, as is illustrated in FIG. 13A. Accordingly, the system is rearranged such that, instead of the aforesaid ratio A/A1, the ratio A/its first-order lag value ADELAY is used hereinafter. Under-the transient engine operating condition, when the throttle valve is opened, a large quantity of air passes the throttle valve all at a time due to the large pressure difference across the throttle valve and then the quantity of air decreases gradually to that under the steady-state engine operating condition as was mentioned before with reference to the bottom of FIG. 10. It is considered that the ratio A/ADELAY can describe the quantity of throttle-past air Gth under such an engine transient operating condition. Under the steady-state engine operating condition, the ratio becomes 1 as will be understood from FIG. 14B. The ratio is referred to as "RATIO-A" as mentioned earlier.

Figure 14A:
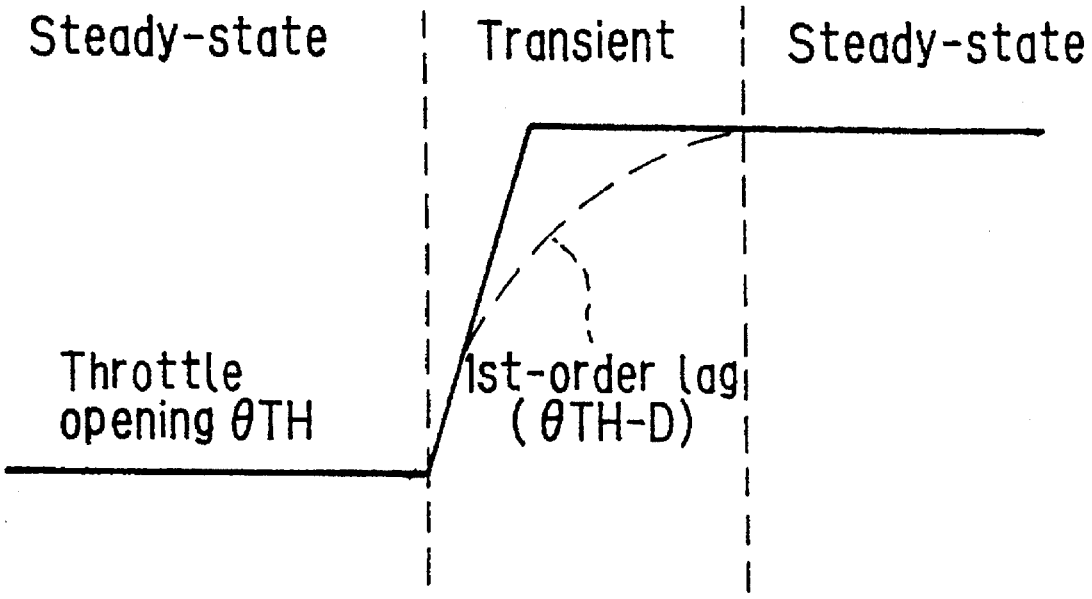
FIGS. 14A and 14B are timing charts explaining the effective throttle opening area's first-order lag value.
Figure 14B:
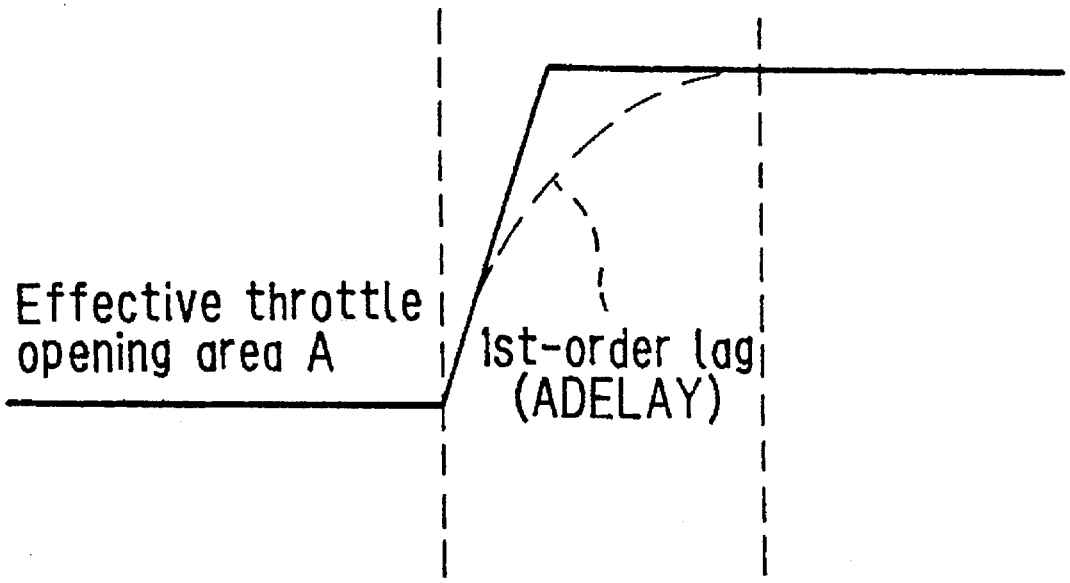

Furthermore, when viewing the relationship between the effective throttle opening area and the throttle opening, since the effective throttle opening area depends greatly on the throttle opening as was shown in Eq. 5, it is considered that the effective throttle opening area will vary almost faithfully following the change of the throttle opening, as illustrated in FIGS. 14A and 14B. If this is true, it can be said that the aforesaid throttle opening's first-order lag value will nearly correspond, in the sense of phenomenon, to the effective throttle opening area's first-order lag value.

In view of the above, it is arranged as illustrated in FIG. 4 such that, the effective throttle opening area's first-order lag value ADELAY is calculated primarily from the first-order of the throttle opening. In the figure, (1-B)/(z-B) is a transfer function of the discrete control system and means the value of the first-order lag.

As illustrated, more specifically, the throttle's projection area S is determined from the throttle opening θTH in accordance with a predetermined characteristic and the discharge coefficient C is determined from the throttle opening's first-order lag value θTH-D and the pseudo-manifold pressure P̂b in accordance with a characteristic similar to that shown in FIG. 7. Then the product of the values is obtained to determine the effective throttle opening area's first-order lag value ADELAY. Thus, as shown in FIG. 4, the first-order lag value θTH-D is first used for determining the effective throttle opening area's first-order lag value ADELAY and is second used to determine, together with the engine speed, the pseudo-manifold pressure P̂b. Furthermore, in order to solve the current quantity of chamber-filling air delta Gb's reflection lag to the quantity of air drawn in the cylinder, the first-order lag value of the value delta Gb is further used.

Based on the above, the operation of the system will be explained with reference to the flowchart of FIG. 3.

The program begins at step S10 in which engine speed Ne, manifold pressure Pb, throttle opening θTH, atmospheric pressure Pa, engine coolant water temperature Tw or the like are read in. The throttle opening has been subject to calibration (learning controlled) in fully closed state at engine idling. The program then proceeds to step S12 in which it is checked if the engine is cranking. If not, the program advances to step S14 in which it is checked if fuel cut is in progress and if not, to step S16 in which the quantity of fuel injection Timap is retrieved from the mapped data (whose characteristic is shown in FIG. 8 and stored in the ROM 58) using the engine speed Ne and manifold pressure Pb read in. Although the quantity of fuel injection Timap may then be subject to atmospheric pressure correction or the like, the correction itself is however not the gist of the invention and no explanation will here be made. The program then proceeds to step S18 in which the throttle opening's first-order lag value θTH-D is calculated, to step S20 in which the pseudo-manifold pressure P̂b is calculated or estimated.

Figure 15:
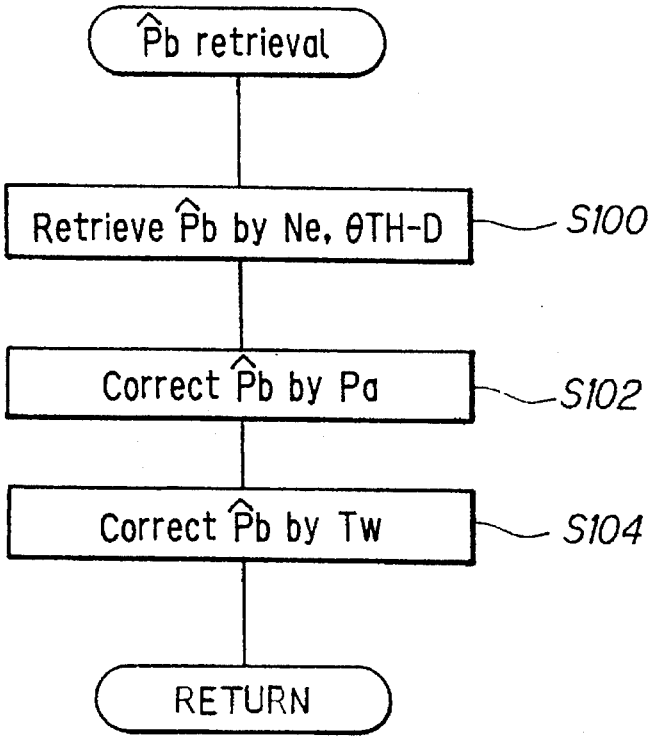
FIG. 15 is a subroutine flowchart of FIG. 3 showing the calculation of a pseudo-manifold pressure.

FIG. 15 is a subroutine flowchart for the calculation. The program begins at step S100 in which the pseudo-manifold pressure P̂b is retrieved from mapped data (whose characteristic is shown in FIG. 16) using the detected engine speed Ne and the throttle opening's first-order lag value θTH-D as address data, and proceeds to step S102 in which the map-retrieved value P̂b is corrected by the detected atmospheric pressure Pa.

Figure 16:
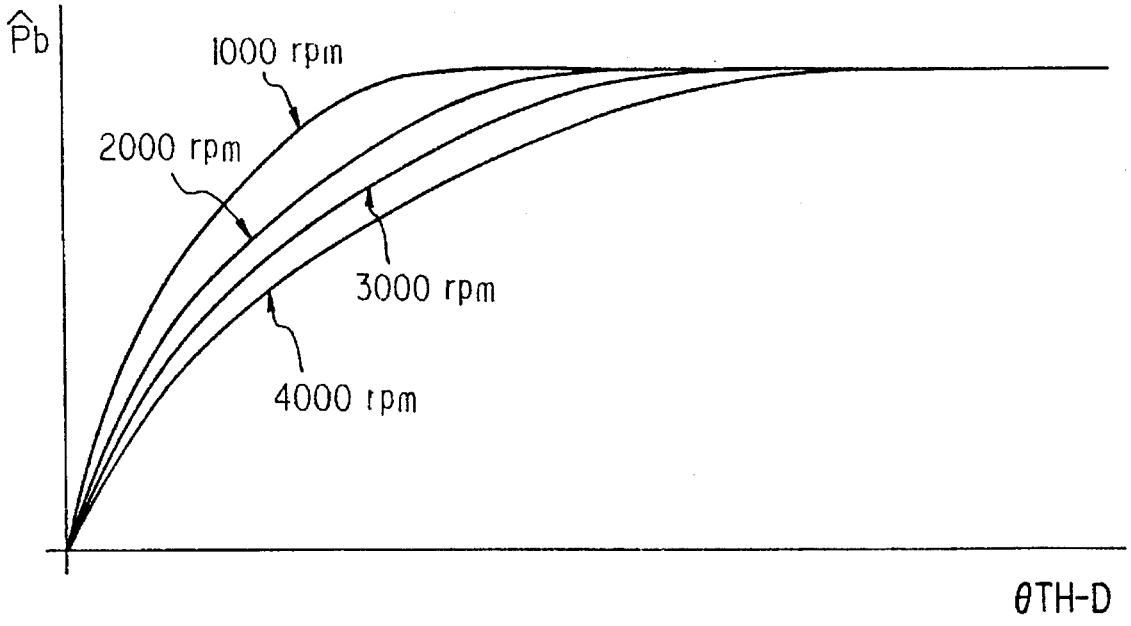
FIG. 16 is a view showing the characteristic of mapped data for retrieving the pseudo-manifold pressure.

Specifically, the mapped data whose characteristic is shown in FIG. 16 are prepared in advance on the condition that the engine has been warmed up, i.e., the engine coolant water temperature Tw is at or above 80° C. Moreover, the mapped data characteristics are prepared on a sea level on the standard conditions, i.e., under the standard atmospheric pressure of 760 mmHg at a normal temperature (e.g., 25° C.). Further, since the throttle valve does not function as an orifice at its wide-open state (full load opening) when the engine speed remains the same, the throttle opening's first-order lag value θTH-D is, as illustrated in FIG. 16, determined with respect to the engine speed used for map retrieval of the pseudo-manifold pressure.

Figure 17A:
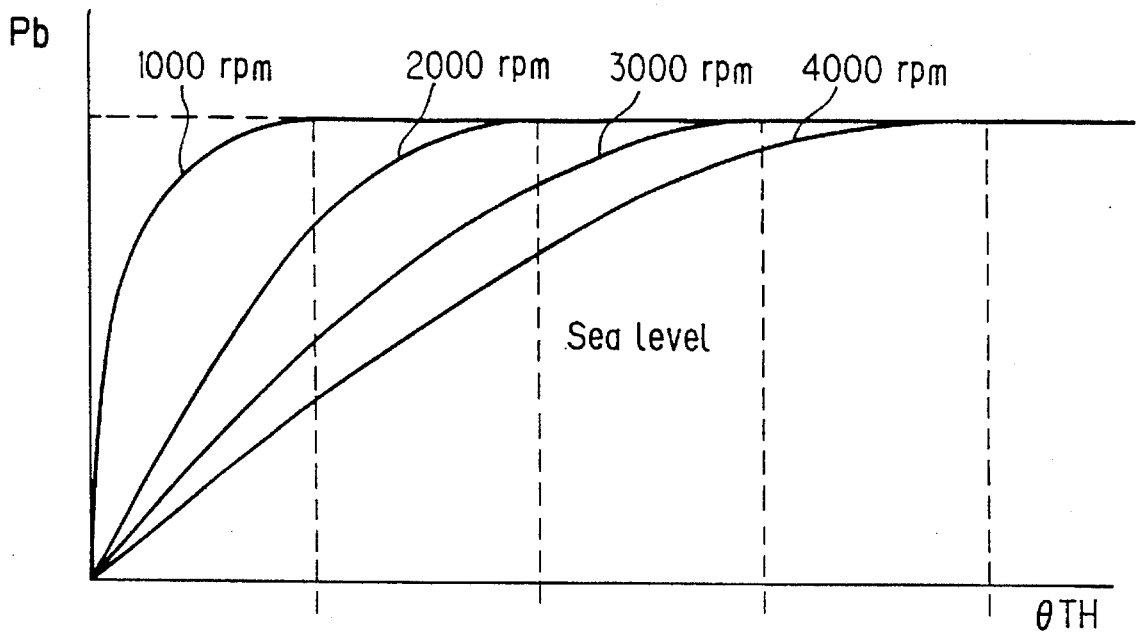
FIGS. 17A is a view showing the marginal (full load) throttle openings with respect to the engine speed at a level ground and FIG. 17B is a view showing that at high altitudes.
Figure 17B:
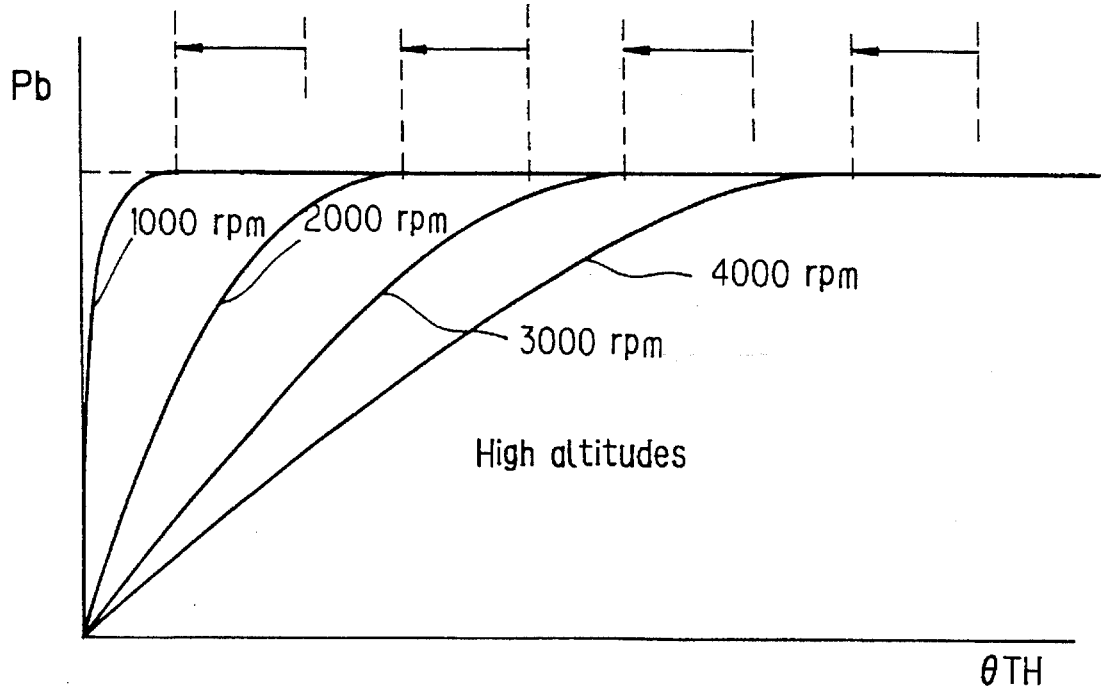

And, the atmospheric pressure Pa decreases as the altitude of the place where the engine is, increases. As a result, at high altitudes the throttle valve reaches the wide-open state (marginal throttle opening) at an opening lesser than that at a sea level, as illustrated in FIGS. 17A and 17B. In other words, a manifold pressure corresponding to a throttle opening differs depending on the atmospheric pressure of the place where the engine is situated. This means that in the characteristic shown in FIG. 16, the pseudo-manifold pressure varies with the atmospheric pressure. For that reason, it is arranged such that the pseudo-manifold pressure obtained through the map retrieval is corrected by the atmospheric pressure of the place where the engine is positioned.

The program proceeds then to step S104 in which the pseudo-manifold pressure is further corrected by the detected engine coolant water temperature. This is because, since the mapped data are prepared on the premise that the engine has been warmed up, if the engine has not been warmed up, i.e., if the engine coolant water temperature is relatively low, the engine friction is large so that the net engine output is less than that the mapped data expects.

Figure 18:
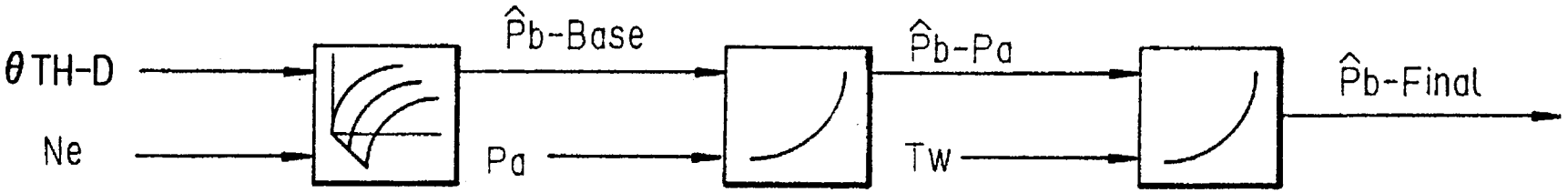
FIG. 18 is a block diagram showing a portion 100 of FIG. 4 in detail.

The determination of the pseudo-manifold pressure is shown in a portion 100 in FIG. 4. FIG. 18 is a view in which the portion 100 is rewritten to show the above corrections more specifically. In FIG. 18, the map-retrieved value is illustrated as +e,cir +ee b-Base, the value further corrected by atmospheric pressure P̂b-Pa, the value further corrected by engine water coolant temperature P̂b-Final.

It should be noted that, although the engine coolant water temperature is used, it is alternatively possible to use other parameters such as an engine oil temperature, an Automatic Transmission Fluid temperature, etc, by providing a sensor for detecting the parameter. The gist of the temperature correction is to correct the pseudo-manifold pressure by a parameter which indicates the temperature of the engine.

It should also be noted in the above that the atmospheric pressure correction to the wide-open throttle limit (full load opening limit) is conducted not only to the value shown in the portion 100, but also to the other portions in which the throttle opening is used for map retrieval. In FIG. 4, more precisely, the atmospheric pressure correction will be conducted for the throttle opening θTH used for determining, together with the pseudo-manifold pressure, the discharge coefficient C that will be multiplied by the projection area S to calculate the effective throttle opening area A, and for the throttle opening's first-order lag value θTH-D used for similarly determining the effective throttle opening area's first-order lag value ADELAY.

Returning to FIG. 3, the program advances to step S22 in which the current effective throttle opening area A is calculated using the throttle opening θTH and the pseudo-manifold pressure P̂b, to step S24 in which the effective throttle opening area's first-order lag value ADELAY is calculated using the θTH-D and P̂b. The program then moves to step S26 in which the value RATIO-A is calculated in the manner shown therein, in which ABYPASS indicates a value corresponding to the quantity of air bypassing the throttle valve 16 such as that flowing in the secondary path 30 and then inducted by the cylinder in response to the amount of lifting of the solenoid valve 74 (illustrated as "quantity of solenoid valve lifting" in FIG. 4). Since it is necessary to take the quantity of bypass air into account to accurately determine the quantity of fuel injection, the quantity of throttle-bypass air is determined in advance in terms of the effective throttle opening area as ABYPASS to be added to the effective throttle opening area A and the sum (A+ABYPASS) and the ratio (RATIO–A) between the first-order lag value of the sum (referred to as "(A+ABYPASS) DELAY") is calculated.

Since the value ABYPASS is added both to the numerator and denominator in the equation shown in step S26, even if there happens to be an error in measuring the quantity of throttle-bypass air, the determination of the quantity of fuel injection will not be damaged seriously. Furthermore, although a detailed explanation is omitted, the additive value is used for determining the pseudo-manifold pressure $\hat{P}b$ etc.

The program then proceeds to step S28 in which the quantity of fuel injection Timap is multiplied by the ratio RATIO-A to determine the quantity of fuel injection TTH corresponding to the quantity of throttle-past air Gth concerned. The program next advances to step S30 in which the difference between the value $\hat{P}b$ just retrieved in the current control (program) cycle, here referred to as "$\hat{P}b(k)$", and the value retrieved in the last control cycle, here referred to as "$\hat{P}b(k-1)$" is determined named delta $\hat{P}b$, to step S32 in which the current quantity of chamber-filling air delta Gb is calculated from the ideal gas law, to step S34 in which its smoothed value, i.e., its first-order lag value delta Gb-D is calculated, to step S36 in which the quantity of correction delta Ti is retrieved from mapped data, whose characteristic is not illustrated but is similar to that shown in FIG. 12, using the value delta Gb-D and the desired air/fuel ratio as address data.

The program then moves to step S38 in which the retrieved value delta Ti is multiplied by a coefficient kta to conduct air's temperature correction. The reason for this is that the ideal gas law (Equation 6) is used in the calculation. The program then proceeds to step S40 in which the quantity of fuel injection TTH is subtracted by the quantity of correction delta Ti to determine the output quantity of fuel injection Tout, to step S42 in which the fuel injector 22 is driven in response thereto. The value Tout is subject beforehand to battery voltage correction or the like, that is also not the gist of the invention so that no explanation will here be made.

If step S12 finds the engine is being cranked, the program passes to step S44 in which the quantity of fuel injection Ticr at cranking is retrieved from a table (not shown) using the engine coolant water temperature Tw as address datum, to step S46 in which the quantity of fuel injection Tout is determined in accordance with an equation for engine cranking (explanation omitted), while if step S14 finds the fuel cut is in progress, the program goes to step S48 in which the output quantity of fuel injection Tout is set to be zero.

With the arrangement, thus, it becomes possible to entirely describe from the steady-state engine operating condition to the transient engine operating condition by a simple algorithm. It also becomes possible to ensure the quantity of fuel injection under the steady-state engine operating condition to a considerable extent by mapped data retrieval, and the output quantity of fuel injection can therefore be determined optimally without conducting complicated calculations. Further, since the equations are not switched between the steady-state engine operating condition and the transient engine operating condition, and since the equations can describe the entire engine operating conditions, control discontinuity, which would otherwise occur in the proximity of switching if the equations were switched between the steady-state and transient engine operating condition, will not happen. Furthermore, since the behavior of air flow is described properly, the arrangement can enhance the convergence and accuracy of the control.

Further, since it is arranged such that the map-retrieved pseudo-manifold pressure is corrected by the atmospheric pressure of the place where the engine is situated and by the engine coolant water temperature and uses the thus corrected pressure, the effective throttle opening area and its first-order lag values are determined, and it becomes possible to determine these values and hence the ratio therebetween more accurately. As a result, it becomes possible to describe the characteristic of the quantity of throttle-past air more properly and determine the quantity of fuel injection over the entire engine operating conditions including the transient engine operating condition more correctly.

Figure 19:
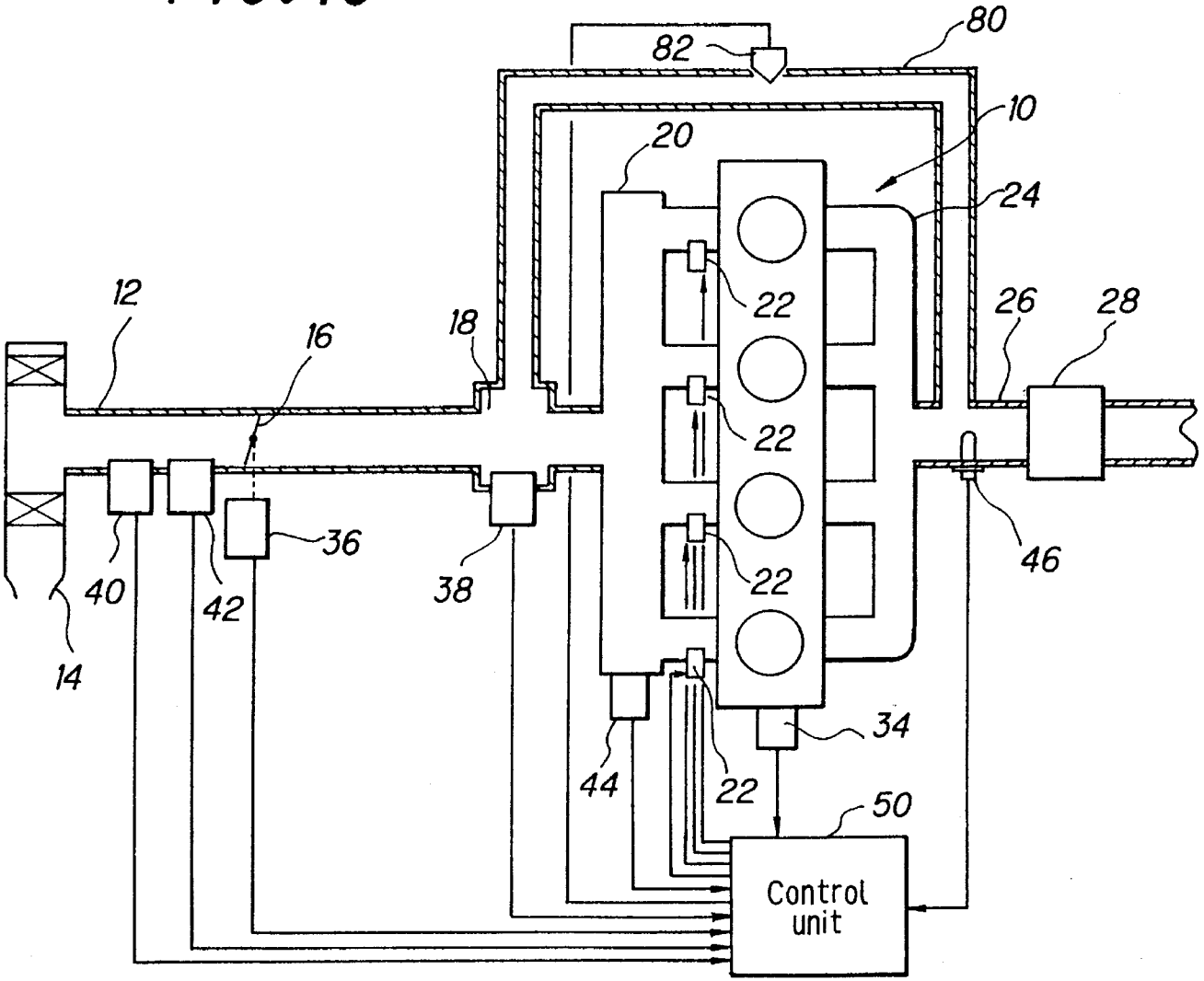
FIG. 19 is a view, similar to FIG. 1, but showing a second embodiment of the invention.

FIG. 19 is a view, similar to FIG. 1, but shows the second embodiment of the invention.

In the second embodiment, the engine 10 is provided with an exhaust gas recirculation system having a passage 80 which connects the exhaust pipe 26 to the intake pipe 12 downstream of the position where the throttle valve 16 is placed. A solenoid valve 82 is installed at the passage 80 which is energized/deenergized by the ECU and when energized, is lifted (opened) to allow the exhaust gas to be recirculated into the intake system. Although the quantity of throttle-bypass air is already taken into account in the first embodiment, when the exhaust gas recirculation (hereinafter referred to as "EGR") is in operation, a larger quantity of exhaust gas will be, without passing through the throttle valve, inducted by the cylinder. Moreover, the recirculated gas brings the intake air temperature up slightly. The second embodiment aims to solve the problem.

Figure 20:
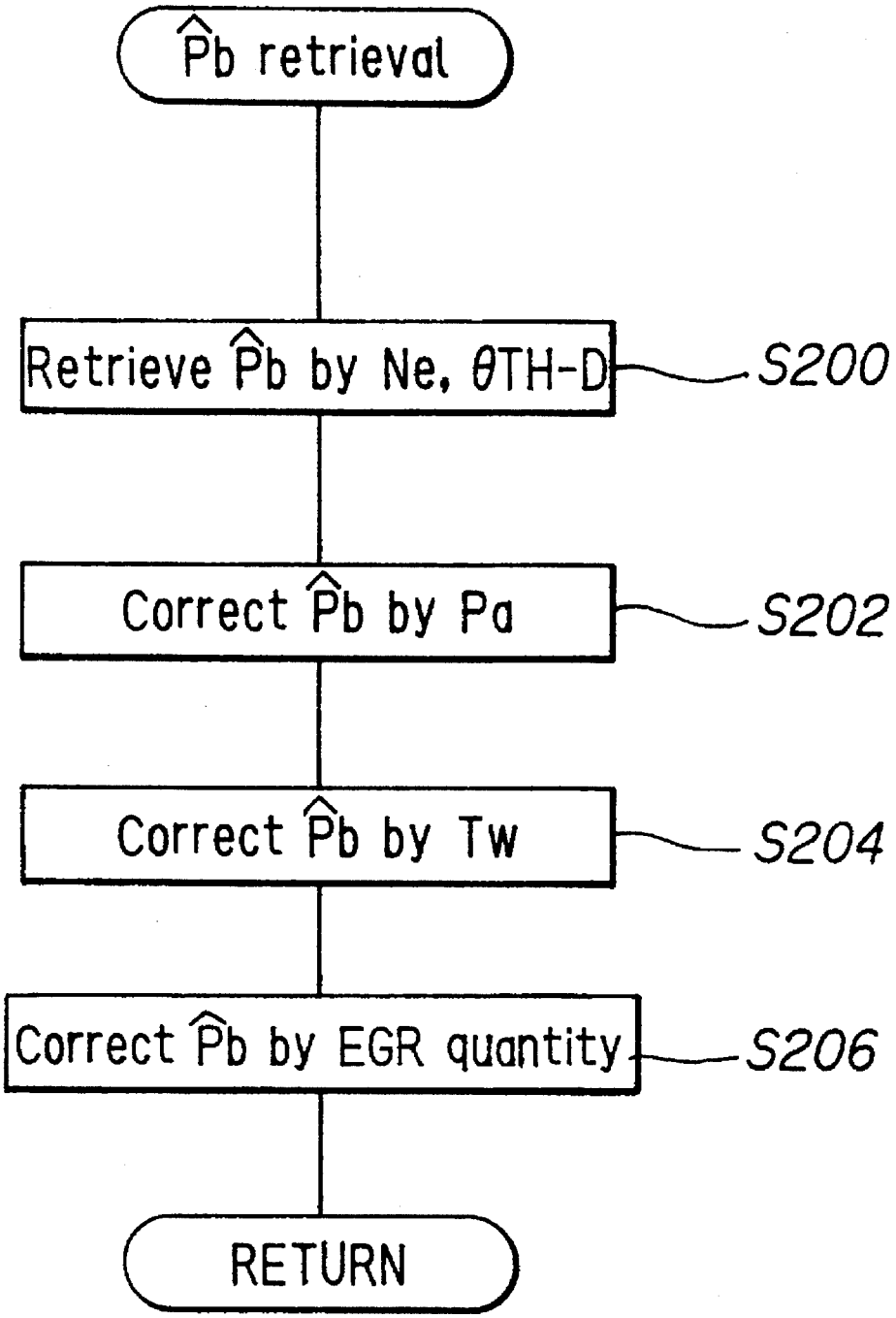
FIG. 20 is a subroutine flowchart, similar to FIG. 15, but showing the operation of the second embodiment.

FIG. 20 is a flowchart, similar to FIG. 15, but showing the operation of the system according to the second embodiment. Explaining this focusing on the difference from FIG. 15, after following steps S200 to S204 similar to the first embodiment, the program proceeds to step S206 in which the map-retrieved pseudo-manifold pressure is corrected by an amount corresponding to the quantity of recirculated gas. Specifically, the quantity of recirculated gas is measured in advance with respect to the engine operating condition and the amount of lifting of the solenoid valve 82, and the correction at step S106 is done by determining the quantity of correction in an appropriate manner in response to the detected engine operating condition and the amount of valve lifting (detected by a sensor not shown).

Figure 21:
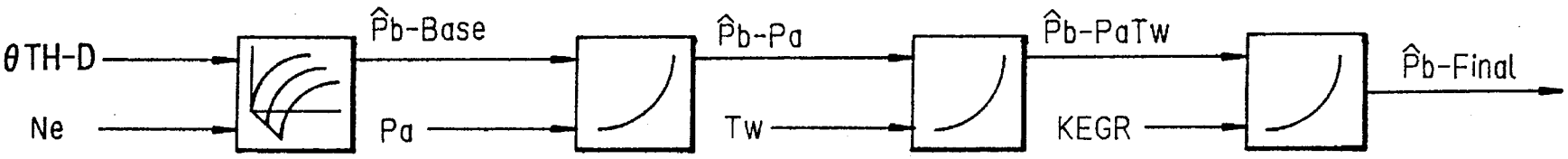
FIG. 21 is a view, similar to FIG. 18, but showing the configuration of the second embodiment.

FIG. 21 shows the configuration of the second embodiment. With the arrangement, it becomes possible to determine the effective throttle opening and its first-order lag value and hence the ratio therebetween in the engine provided with the EGR system, enabling the determination of the quantity of fuel injection more properly.

Figure 22:
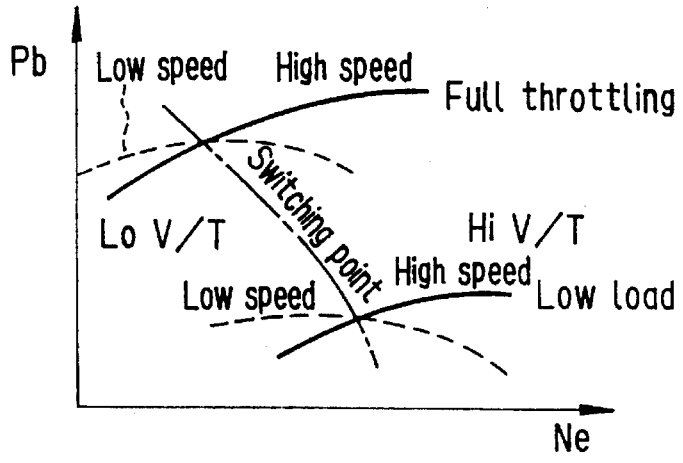
FIG. 22 is a graph showing the third embodiment of the invention.

FIG. 22 is a view showing the third embodiment of the invention.

The figure illustrates a characteristic of operation of the so-called variable valve timing mechanism. The variable valve timing mechanism is taught by, for example, Japanese Laid-Open Patent Application 2(1990)-275,043. In the mechanism, the opening/closing timing of the intake and/or exhaust valve is switched between two kinds of characteristics in response to the engine operating condition mainly defined by the engine speed Ne and the manifold pressure Pb. The two kinds of characteristics are illustrated as "Lo V/T" and "Hi V/T" in FIG. 22. The former characteristic (Lo V/T) is selected when the engine speed and load are relatively low, while the latter characteristic (Hi V/T) is selected in the other region. Since the mechanism itself is known, no further explanation will be made here.

The third embodiment is thus directed to the engine having such a variable valve timing mechanism, since when the valve timing characteristic is switched, the combustion state and charging efficiency of the engine may change. As a result, when the characteristic of the mapped data shown in FIG. 16 is preestablished based on one of the valve timing characteristic, if the valve timing is switched to the other, the charging efficiency may accordingly change, occasionally resulting in an improper map-retrieval value improper. In the third embodiment, in view of the above, the mapped data are prepared respectively for the two kinds of valve timing characteristics.

Figure 23:
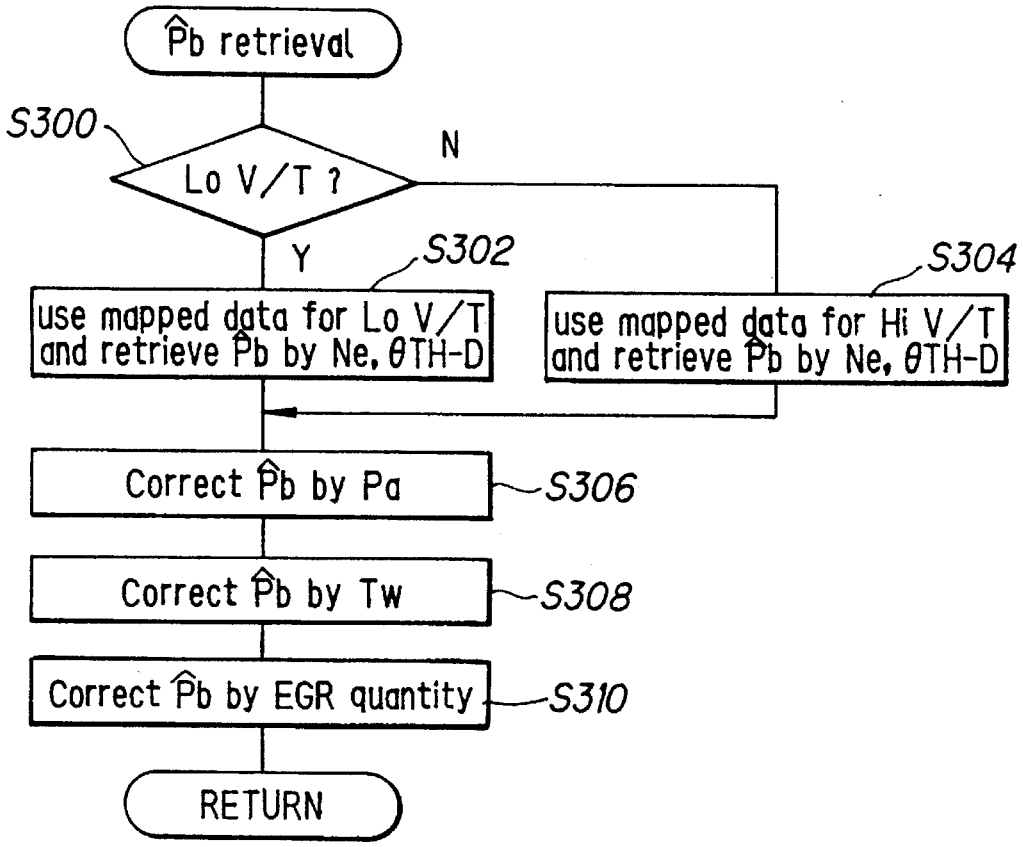
FIG. 23 is a flowchart, similar to FIG. 15, but showing the operation of the third embodiment of the invention.

FIG. 23 is a flowchart showing the operation of the third embodiment. In the flowchart, the program starts at step S300 in which it is confirmed whether the Lo V/T characteristic is selected. This is done, for example, by checking a flag used in a control system (not shown) for the valve timing mechanism. If it is confirmed in the step that the Lo V/T characteristic is selected, the program goes to step S302 in which mapped data for Lo V/T (not shown) is used for retrieving the pseudo-manifold pressure. On the other hand, when the result is negative, the program proceeds to step S304 in which mapped data for Hi V/T (not shown) is used for the retrieval. The program then proceeds to steps S306 to S310 similar to the second embodiment to correct the map-retrieval value.

With the arrangement, it becomes possible to determine the effective throttle opening and its first-order lag value and the ratio therebetween in the engine provided with the variable valve timing mechanism, enabling the quantity of fuel injection to be determined more properly.

It should be noted that in the first embodiment, although the quantity of air passing through the secondary path 30 is determined in terms of the effective throttle opening area and its first-order lag value and is added thereto, it is alternatively possible to determine the quantity of throttle-bypass air for addition in an engine that is not provided with the secondary path 30.

It should also be noted that in the foregoing embodiments, although the various corrections are made to the map-retrieval value, it is alternatively possible to omit one or some of the corrections. For instance, it is possible to only prepare the mapped data respectively for the Lo V/T and Hi V/T valve timing characteristics in the third embodiment and not to conduct the corrections mentioned in the steps from S306 to S308.

It should further be noted that in the foregoing, in determining the first-order lag behavior of the quantity of correction delta Ti, the first-order lag value of the current quantity of chamber-filling air delta Gb is first calculated and the value delta Ti is then calculated therefrom in accordance with the characteristic similar to that shown in FIG. 12. The invention is not limited to the disclosure and it is alternatively possible to obtain the first-order lag value of the pseudo-manifold pressure delta $\hat{P}b$ or the value delta Ti itself.

It should further be noted that although the quantity of correction delta Ti is prepared in advance as mapped data, it is alternatively possible to obtain it by partially or wholly carrying out the calculations.

It should further be noted that although the change of the pseudo-manifold pressure delta $\hat{P}b$ is obtained from the difference between the values obtained at the current and last control cycles, it is alternatively possible to use a value obtained at the control cycle preceding thereto. Further it is alternatively possible to use a differential or a differential integral of the values.

It should further be noted that, although the output quantity of fuel injection Tout is obtained by subtracting the quantity of correction delta Ti corresponding to the quantity of chamber-filling air from the quantity of fuel injection Timap, it is alternatively possible to determine the output quantity of fuel injection Tout immediately from the quantity of fuel injection Timap, when the engine has only one cylinder with a chamber volume small enough to be neglected.

It should further be noted that, although the effective throttle opening area's first-order lag value is determined using the throttle opening's first-order lag value, it is alternatively possible to obtain the effective throttle opening area's first-order lag value itself.

It should further be noted that, although the quantity of fuel injection Timap is prepared in advance as mapped data, it is alternatively possible to prepare, instead of the value Timap, the quantity of throttle-past air Gth as mapped data. Although the alternative will be disadvantageous in that it could not absorb the change in the quantity of air drawn in the cylinder due to pulsation or an error resulting when the fuel injector's characteristic is not linear, it will nevertheless be possible to attain the object of the invention to some extent.

It should further be noted that, although the first-order lag value is used for ADELAY, θTH-D, it is alternatively possible to use the second-order or more lag value.

While the invention has thus been shown and described with reference to the specific embodiments. However, it should be noted that the invention is in no way limited to the details of the described arrangements, changes and modifications may be made without departing from the scope of the appended claims.

What is claimed is:

1. A system for controlling fuel metering in an internal combustion engine, including:

engine operating condition detecting means for detecting parameters indicating an engine operating condition at least including an engine speed (Ne), a manifold pressure (Pb) and a throttle valve opening (θTH);

fuel injection quantity obtaining means for obtaining a quantity of fuel injection (Timap) in accordance with a predetermined characteristic at least based on the engine speed (Ne) and the manifold pressure (Pb);

pseudo-manifold pressure determining means for determining an n-th order lag value (θTH-D) of the throttle valve opening (θTH) to determine a pseudo-manifold pressure ($\hat{P}b$) at least based on the n-th order lag value (θTH-D) and the engine speed (Ne);

first effective throttle opening area determining means for determining an effective throttle opening (A) at least based on the throttle valve opening (θTH) and the pseudo-manifold pressure ($\hat{P}b$);

second effective throttle opening area determining means for determining a value (ADELAY) indicating an n-th order lag of the effective throttle opening area (A) at least based on the n-th order lag value (θTH-D) of the throttle valve opening (θTH) and the pseudo-manifold pressure ($\hat{P}b$); and fuel injection quantity determining means for determining a quantity of fuel injection (Tout) by multiplying the quantity of fuel injection (Timap) by a ratio between the effective throttle opening area (A) and the value (ADELAY) as $$Tout=Timap \times A/ADELAY$$

wherein the improvement comprises:

said first and second effective throttle opening area determining means corrects the pseudo-manifold pressure ($\hat{P}b$) by the engine operating condition.

2. A system according to claim 1, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

3. A system according to claim 1, wherein said engine has a passage which connects an exhaust pipe to an intake pipe to recirculate exhaust gas into the intake pipe, and said first and second effective throttle opening area determining means corrects the pseudo-manifold pressure ($\hat{P}b$) by an amount of exhaust gas recirculation.

4. A system according to claim 3, wherein said engine is provided with a variable valve timing mechanism which switches an-opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

5. A system according to claim 1, wherein said first and second effective throttle opening area determining means corrects the pseudo-manifold pressure ($\hat{P}b$) by an engine temperature.

6. A system according to claim 5, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

7. A system according to claim 5, wherein said engine has a passage which connects an exhaust pipe to an intake pipe to recirculate exhaust gas into the intake pipe, and said first and second effective throttle opening area determining means corrects the pseudo-manifold pressure ($\hat{P}b$) by an amount of exhaust gas recirculation.

8. A system according to claim 7, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

9. A system according to claim 1, wherein said first and second effective throttle opening area determining means corrects the pseudo-manifold pressure ($\hat{P}b$) at an atmospheric pressure where the engine is.

10. A system according to claim 9, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

11. A system according to claim 9, wherein said engine has a passage which connects an exhaust pipe to an intake pipe to recirculate exhaust gas into the intake pipe, and said first and second effective throttle opening area determining means corrects the pseudo-manifold pressure ($\hat{P}b$) by an amount of exhaust gas recirculation.

12. A system according to claim 11, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

13. A system according to claim 9, wherein said first and second effective throttle opening area determining means corrects the pseudo-manifold pressure ($\hat{P}b$) by an engine temperature.

14. A system according to claim 13, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

15. A system according to claim 12, wherein said engine is provided with a passage which connects an exhaust pipe to an intake pipe to recirculate exhaust gas into the intake pipe, and said first and second effective throttle opening area determining means corrects the pseudo-manifold pressure ($\hat{P}b$) by an amount of exhaust gas recirculation.

16. A system according to claim 15, wherein said engine is provided with a variable valve timing mechanism which switches an opening/closing timing of at least one of an intake valve and an exhaust valve between a plurality of characteristics in response to the engine operating condition, and said first and second effective throttle opening area determining means corrects the pseudo-manifold pressure ($\hat{P}b$) by a selected one of the characteristics.

* * * * *